US008842020B2

(12) United States Patent
Clark et al.

(10) Patent No.: US 8,842,020 B2
(45) Date of Patent: Sep. 23, 2014

(54) SYSTEM AND METHOD FOR DETECTING CASING IN A FORMATION USING CURRENT

(75) Inventors: Brian Clark, Sugar Land, TX (US); Jan S. Morley, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 913 days.

(21) Appl. No.: 13/003,428

(22) PCT Filed: May 12, 2009

(86) PCT No.: PCT/US2009/043531

§ 371 (c)(1), (2), (4) Date: Jan. 10, 2011

(87) PCT Pub. No.: WO2010/011395

PCT Pub. Date: Jan. 28, 2010

(65) Prior Publication Data

US 2011/0109470 A1 May 12, 2011

Related U.S. Application Data

(60) Provisional application No. 61/083,384, filed on Jul. 24, 2008.

(51) Int. Cl.
*G01V 3/00* (2006.01)
*E21B 47/022* (2012.01)

(52) U.S. Cl.
CPC ..... *E21B 47/022* (2013.01)
USPC ..... 340/854.6; 340/853.1; 340/853.8; 340/854.1; 340/854.3

(58) Field of Classification Search
USPC ..... 340/853.1, 854.1, 854.3, 854.6
See application file for complete search history.

(56) References Cited

U.S. PATENT DOCUMENTS

| | | | | |
|---|---|---|---|---|
| 3,967,201 | A * | 6/1976 | Rorden | 340/854.5 |
| 4,700,142 | A | 10/1987 | Kuckes | |
| 4,791,373 | A | 12/1988 | Kuckes | |
| 5,218,301 | A | 6/1993 | Kuckes | |
| 5,485,089 | A * | 1/1996 | Kuckes | 324/346 |
| 2008/0018334 | A1 | 1/2008 | Reiderman | |
| 2008/0041626 | A1 | 2/2008 | Clark | |

FOREIGN PATENT DOCUMENTS

| | | |
|---|---|---|
| WO | 9411762 | 5/1994 |

* cited by examiner

*Primary Examiner* — Andrew Bee
(74) *Attorney, Agent, or Firm* — Kimberly Ballew

(57) ABSTRACT

The present disclosure is directed to systems and methods for relative positioning of wells. A method in accordance with an exemplary embodiment may include drilling a new well in a field having at least three completed wells using a drilling tool that includes a magnetometer. The method may further include driving current on a first pair of the at least three completed wells and then driving current on a second pair of the at least three completed wells, wherein the current is driven on each of the first and second pairs in a balanced mode. The method may also include measuring a direction of a first magnetic field generated by the current on the first pair using the magnetometer, measuring a direction of a second magnetic field generated by the current on the second pair using the magnetometer, and determining a location of the drilling tool relative to the completed wells based on the direction of the first magnetic field and the direction of the second magnetic field.

20 Claims, 27 Drawing Sheets

SYSTEM AND METHOD FOR DETECTING CASING IN A FORMATION USING CURRENT

FIELD OF THE INVENTION

The present disclosure relates generally to well drilling operations and, more particularly, to a system and method for drilling a well in a position relative to existing wells using information acquired based on a measurable magnetic field produced via electrical current injected into a formation.

BACKGROUND OF THE INVENTION

In order to access certain types of hydrocarbons in the earth, it may be necessary or desirable to drill wells or boreholes in a certain spatial relationship with respect to one another. Producing unconventional oil such as shale oil, heavy oil, or bitumen, may require technology that utilizes an arrangement of boreholes. For example, heavy oil may be too viscous in its natural state to be produced from a conventional well, and, thus, an arrangement of cooperative wells and well features may be utilized to produce such oil. Indeed, to produce certain types of unconventional oil, it may be desirable to drill numerous boreholes in a patterned arrangement such that some wells can be used to condition a formation and other wells can be used to produce oil from the formation. Thus, in the process of arranging such a pattern of boreholes, it may be desirable to drill a borehole such that it has a specific location relative to one or more previously drilled boreholes.

As a specific example of utilizing an arrangement of wells to access unconventional oil, heating an oil-bearing formation to very high temperatures with an arrangement of heating wells can facilitate cracking heavy oil or bitumen into lighter hydrocarbons that can be more easily produced due to their reduced viscosity. Similarly, shale oil may be produced from kerogen by a process that includes providing very high temperatures in the shale formation via an arrangement of wells. Such in situ upgrading and conversion processes generally require a large number of heater wells to raise the formation temperature to several hundred degrees C. Indeed, this may require hundreds of heater wells drilled in a dense pattern. Also, there are numerous other situations that may benefit from a densely packed arrangement of wells.

Well patterns utilized for accessing certain types of oil may have an inter-well spacing of only a few meters. To achieve certain well pattern arrangements, each well may need to be kept within what is essentially an imaginary cylinder within a formation, wherein each imaginary cylinder has a radius of a few meters (e.g., 1.5 meter radius). Using many conventional techniques, it may be difficult to accurately drill one well in a specified relationship relative to another well. Indeed, standard measurement while drilling (MWD) direction and inclination measurements are usually too inaccurate to maintain proper spacing and relative positioning between two wells over a substantial distance. In part, this is because the location of each well becomes more uncertain as the length of the well increases. For example, the uncertainties may be represented as ellipses at different well lengths that represent the area in which the well may be located at a particular point. These ellipses increase in area with drilled depth. Thus, it may be difficult to accurately position wells relative to one another. Indeed, if the ellipses for a pair of wells overlap, there is potential for a collision between the wells.

SUMMARY

Certain aspects commensurate in scope with the originally claimed embodiments are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

One method in accordance with exemplary embodiments includes a method for relative positioning of wells. The method may include drilling a new well in a field having at least three completed wells using a drilling tool comprising a magnetometer, driving current on a first pair of the at least three completed wells and then driving current on a second pair of the at least three completed wells, wherein the current is driven on each of the first and second pairs in a balanced mode, measuring a direction of a first magnetic field generated by the current on the first pair using the magnetometer, measuring a direction of a second magnetic field generated by the current on the second pair using the magnetometer, and determining a location of the drilling tool relative to the completed wells based on the direction of the first magnetic field and the direction of the second magnetic field.

Another method in accordance with exemplary embodiments may include a method of drilling wells relative to one another, wherein the method includes measuring components of a first magnetic field generated from a first balanced current on a first well pair with a magnetometer, determining a first magnetic field direction of the first magnetic field based on the components of the first magnetic field with a processor, measuring components of a second magnetic field generated from a second balanced current on a second well pair with the magnetometer, determining a second magnetic field direction of the second magnetic field based on the components of the first magnetic field with the processor, and determining a location of the magnetometer relative to the first and second well pair based on the first and second magnetic field directions.

A system in accordance with exemplary embodiments may include a system for drilling wells in an arrangement relative to one another. Specifically, the system may include a current generator balanced transformer, cable extending from the current generator balanced transformer, wherein the cable is capable of coupling a pair of completed wells with the current generator balanced transformer such that current from the current generator balanced transformer can pass through the pair of completed wells in a current balanced mode, and a drilling tool comprising a magnetometer capable of detecting a direction of a magnetic field produced by the current passing through the pair of completed wells to facilitate calculation of a location of the drilling tool relative to the pair of completed wells.

BRIEF DESCRIPTION OF THE DRAWINGS

Advantages of the invention may become apparent upon reading the following detailed description and upon reference to the drawings in which.

DETAILED DESCRIPTION OF SPECIFIC EMBODIMENTS

Figure 1:
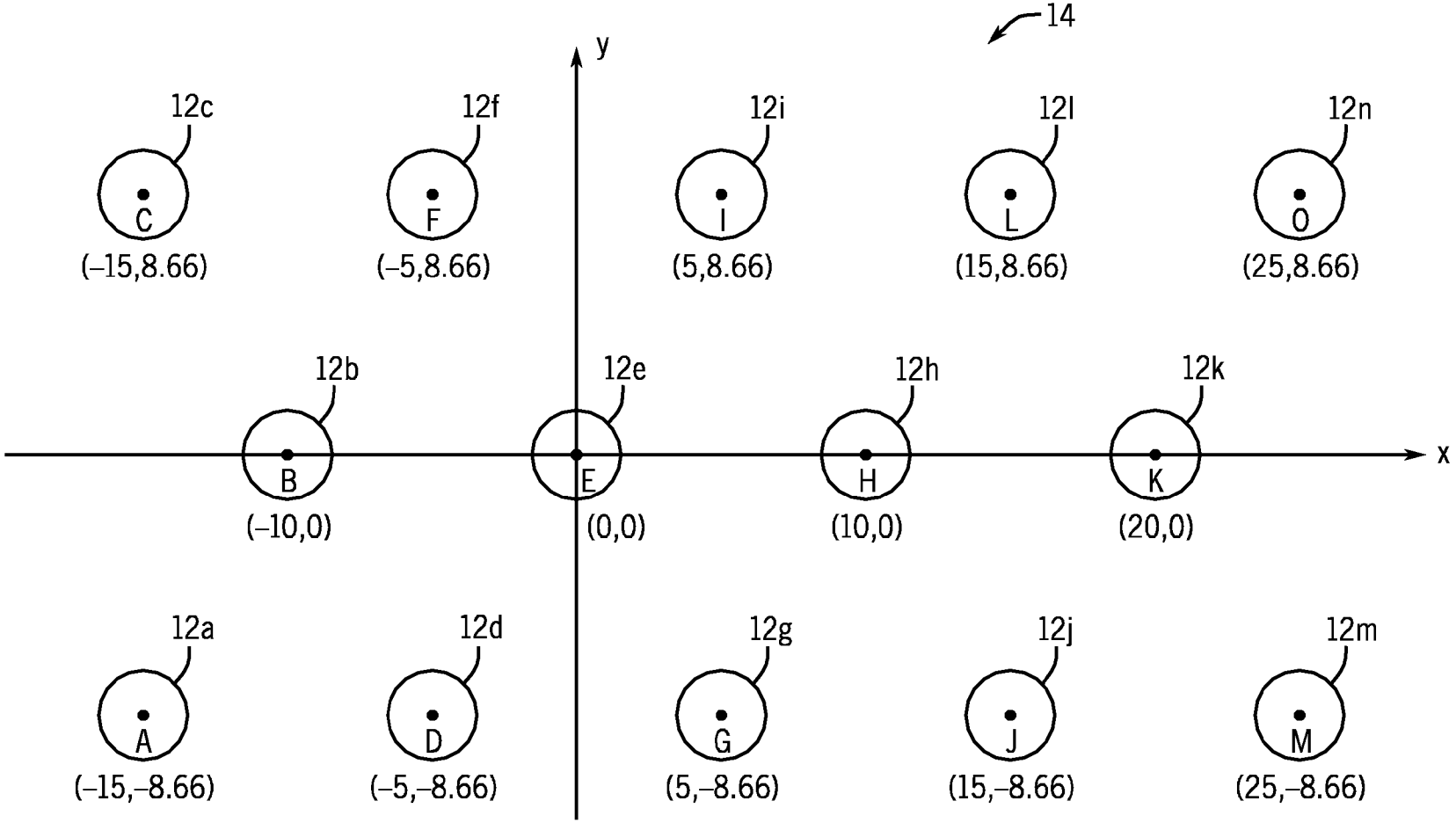
FIG. 1 includes a cross-sectional view of an arrangement of parallel completed wells in accordance with an exemplary embodiment.

One or more specific embodiments of the present invention are described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

In the following detailed description, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Exemplary embodiments in accordance with the present invention are directed to systems and methods for drilling wells in positions relative to existing wells. Exemplary embodiments may include a method and/or a system for accurately placing a large number of wells in a predetermined pattern. Specifically, an exemplary embodiment includes positioning a borehole assembly (BHA) in a drill string relative to at least three completed wells based on relative positioning information obtained by injecting electrical currents on pairs of completed wells. In one embodiment, this involves injecting currents on pairs of completed wells and measuring the resulting magnetic fields downhole with an MWD tool containing a three-axis magnetometer. This may be repeated on different pairs of wells and the resulting magnetic fields may be detected with a magnetic field sensor positioned in the well being drilled (e.g., within a BHA). The measurements of the detected fields may be utilized in conjunction with one another to determine a position of the well being drilled relative to the existing wells.

The currents may be injected at the surface via casing or the like such that a measurable magnetic field is produced underground in a formation. The completed wells must have a conductive metal feature (e.g., a tubular) to carry the current. Hereafter, "completed well" will refer a well with a conductive feature, such as a metal casing, metal liner, slotted liner, heater encased in metal, coil tubing, metal cable, or any metal feature placed in the well that can conduct electric current into the formation.

In one embodiment, currents may be applied to a first pair of completed wells, and the direction of the resulting magnetic field may be measured with a magnetometer in a BHA positioned in the incomplete well. Then, currents may be applied to a second pair of completed wells, which may produce a different magnetic field direction. If the positions of the completed wells are known, the two directions can be used to triangulate the position of the drill string with respect to the positions of the completed wells. Furthermore, once the BHA position has been determined, the currents on the casings can be determined and used to enhance the position measurement. The electric currents may be injected onto a pair of wells in a balanced mode with respect to Earth ground, such that a positive voltage appears on one well head, and a negative voltage of equal magnitude appears on the other well head. In an exemplary embodiment, low frequency AC currents (e.g., 10 Hertz or less) may be used.

FIG. 1 includes a cross-sectional view of an arrangement of parallel completed wells 12 in accordance with an exemplary embodiment. Each of the wells 12 is illustrated as a circle, which represents a cross-section of a cylinder having a certain radius (e.g., 1.5 meters) within which the well itself is supposed to lie. As indicated above, this type of accuracy in well placement cannot be achieved by standard MWD direction and inclination measurements, but requires an active ranging technique.

In the illustrated embodiment, the wells 12 are arranged in a pattern or array 14 wherein the wells 12 are positioned in relation to one another such that the lengths between them form equilateral triangles with an inter-well spacing of 10 meters between all adjacent wells. In FIG. 1, a coordinate system is defined with the x-direction along a length of the array 14 and the y-direction transverse to the array 14. All of the illustrated wells 12 are depicted as being generally aligned with the z-direction. For illustrative purposes, the wells 12 may be considered vertical wells. However, it should be noted that exemplary embodiments may be equally applicable to deviated wells or horizontal wells.

In FIG. 1, the array 14 is illustrated as including fourteen wells. Specifically, the array includes wells 12*a*, 12*b*, 12*c*, 12*d*, 12*e*, 12*f*, 12*g*, 12*h*, 12*i*, 12*j*, 12*k*, 12*l*, 12*m*, and 12*n*. While only wells 12*a*-12*n* are illustrated, additional wells may be utilized in accordance with exemplary embodiments. For example, in the illustrated embodiment, additional wells may be considered to extend along the +x-direction. Indeed, any number of additional wells may be drilled sequentially from left to right (i.e. progressing along the +x-direction) in the illustrated embodiment. In other embodiments, wells may be drilled in other directions as well. As soon as each of the wells 12 is drilled to bottom, the drill string may be removed and a casing or other metallic completion feature may be inserted in the new borehole.

Figure 2:
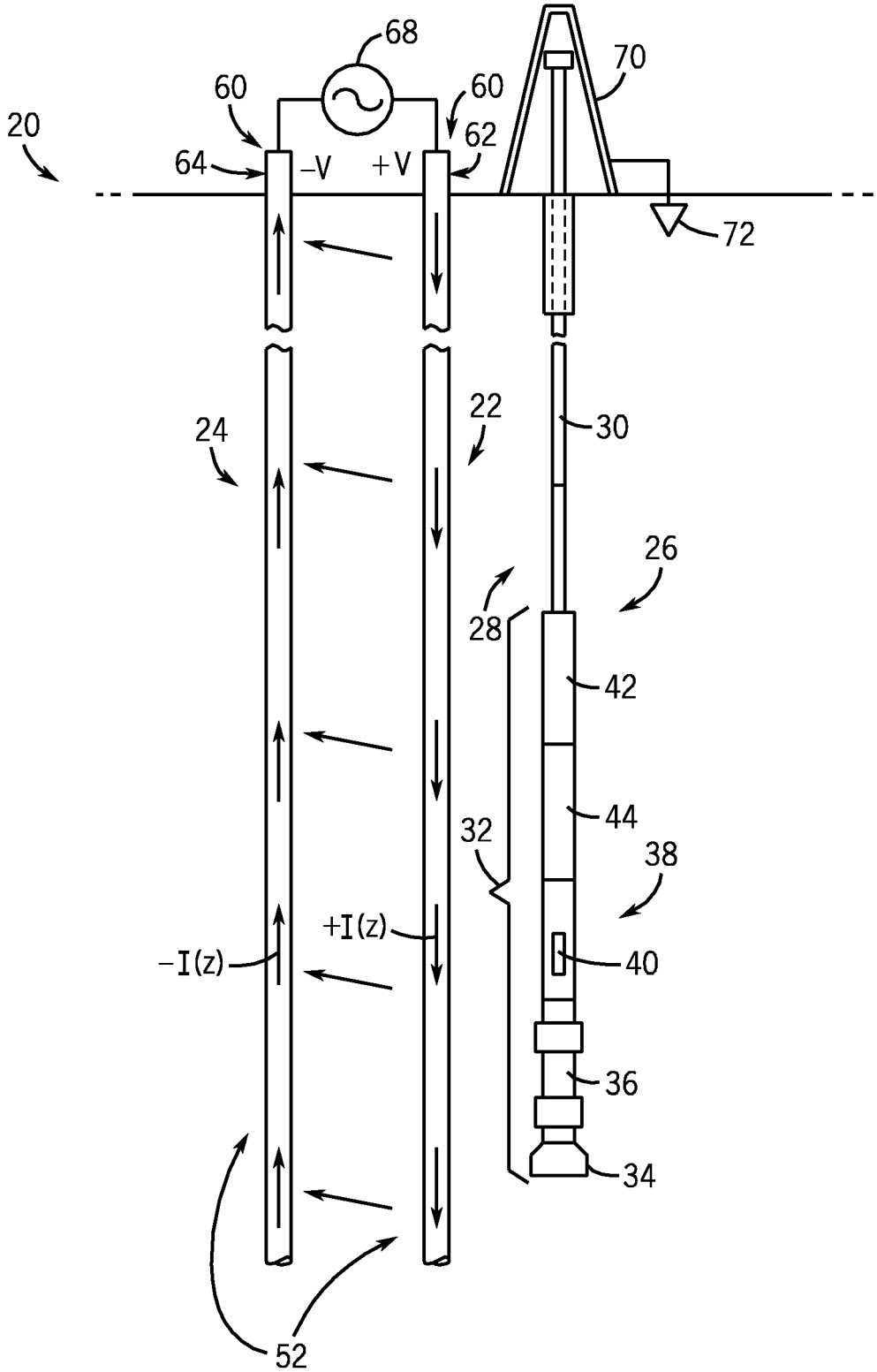
FIG. 2 includes a cross-sectional representation of a drilling system in accordance with an exemplary embodiment.

FIG. 2 includes a cross-sectional representation of a drilling system 20 in accordance with an exemplary embodiment. Specifically, FIG. 2 illustrates a first completed well 22, a second completed well 24, and a well being drilled 26. In the illustrated embodiment, the well being drilled 26 includes a drill string 28, which includes drill pipe 30 and a BHA 32 positioned therein. The BHA 32 includes a drill bit 34, a steerable system 36, at least one measurement sub 38 with at least one magnetometer 40 (e.g., a three-axis magnetometer), various drill collars 42, and so forth. The drill string 28 also contains a communication feature that is capable of communicating data to the surface, such as an MWD tool 44 in the BHA 32, wherein the MWD tool 44 is capable of communicating via mud pulse, electromagnetic telemetry, and/or the like.

In the illustrated embodiment, the first completed well 22 and the second completed well 24, which may be conjunctively referred to as the completed wells 52, are generally parallel to one another. Further, the drill string 28 is approximately parallel to the completed wells 52. The completed wells 52 may include well heads 60. Specifically, the first completed well 22 includes a first well head 62, and the second completed well 24 includes a second well head 64. The well heads 60 of the completed wells 52 may be assumed to be electrically isolated from other surface components, such as pipes or tubing. Further, in an exemplary embodiment, the well heads 60 are attached to an AC current generator 68 that is capable of providing high currents at relatively low frequencies (e.g. typically 10 Hertz or less). A time dependence of the form $e^{j\omega t}$ may be assumed, where $\omega=2\pi f$ is the angular frequency and f is the frequency in Hertz.

In accordance with one embodiment, the AC current generator 68 may be used because the magnetometer 40 and front-end circuits may be designed to block DC magnetic fields. The Earth's magnetic field is approximately 50,000 nanoTesla, which may be significantly larger than the magnetic field due to currents on the completed wells 52 (e.g., on casing or other conductive features of the completed wells 52). By using a high pass filter on the magnetometer output, the DC Earth magnetic field may be blocked, and, thus, the measurement resolution and accuracy may be increased. However, an exemplary embodiment, DC currents may also be used on the completed wells 52. When DC currents are utilized, the magnetic field may be measured with a first polarity for the DC current, and then measured with the current's polarity reversed. This may involve subtracting two large magnetic field values to eliminate the contribution from the Earth's magnetic field.

The current generator 68 may be operated in a balanced mode with respect to Earth ground such that positive voltage +V appears on one well head (e.g., the first well head 62) and negative voltage −V appears on the other well head (e.g., the second well head 64) with respect to electrical Earth ground. For example, the current generator 68 may be coupled to the well heads 60 via a balanced transformer with a center tap that is connected to ground (Earth). A drilling rig 70 that is capable of being used to manipulate the BHA 32 may also be grounded with an electrical ground 72 to facilitate operation and avoid conductance issues.

Let the current injected at the well heads 60 be denoted as I(0). The current along the first completed well 22 is I(z), where the measured depth is z, and the current along the second completed well 24 is −I(z). The current will immediately begin to leak into the earth in the vicinity of each of the completed wells 52 and subsequently decrease with increasing depth. Because the voltage drop is applied across the completed wells 52, the current is essentially confined to the conductive features (e.g., casing) of the completed wells 52 and the immediate formation surrounding the completed wells 52. If there are no other wells that include conductive features close to the completed wells 52, then the majority of the current will typically flow on the conductive features of the completed wells 52 and be balanced, i.e. I(z) and −I(z).

Figure 3:
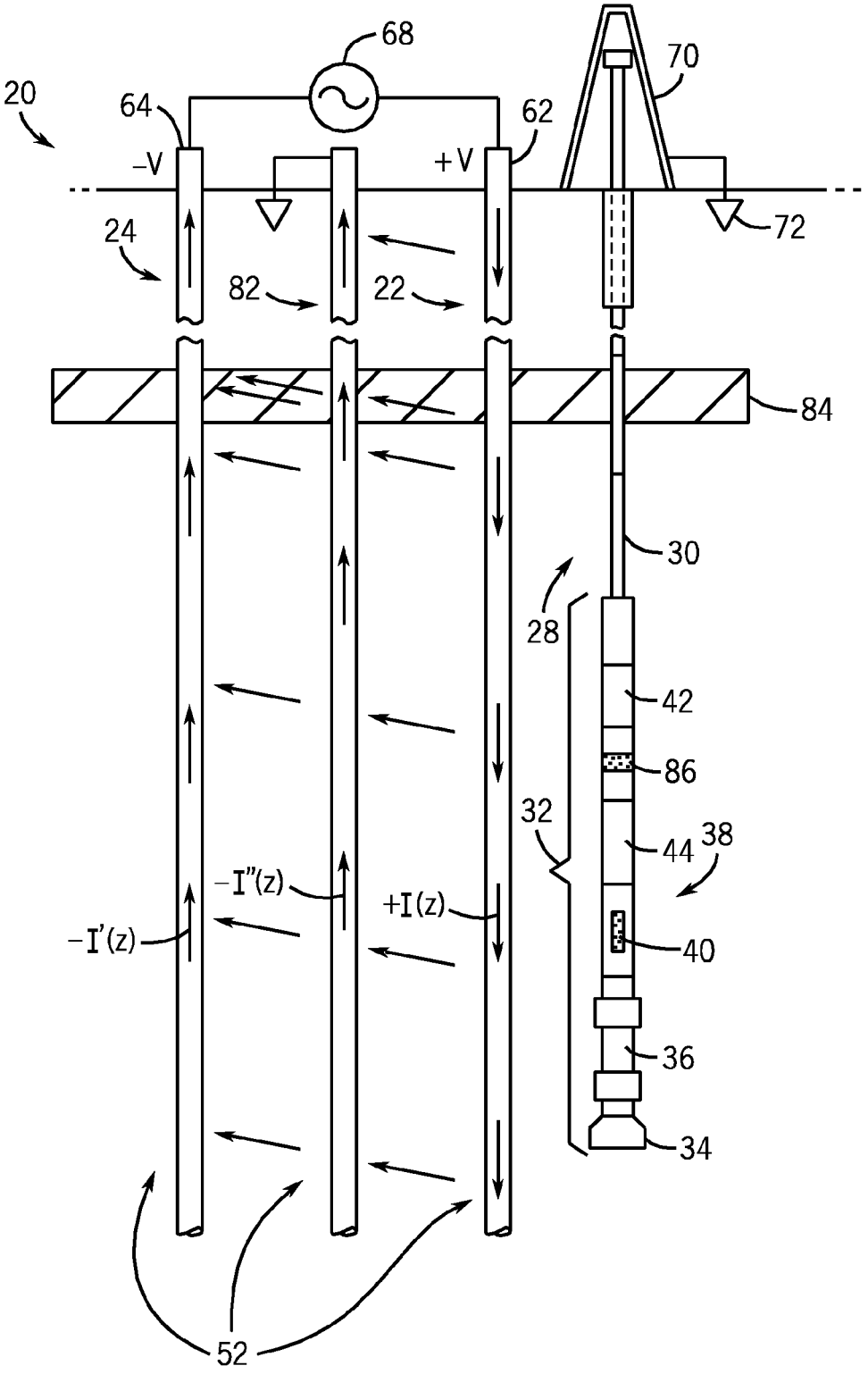
FIG. 3 includes a cross-sectional representation of a drilling system in accordance with an exemplary embodiment.

FIG. 3 includes a cross-sectional representation of the drilling system 20 of FIG. 2 wherein the completed wells 52 include an additional well in accordance with an exemplary embodiment. Specifically, FIG. 3 illustrates the drilling system 20 with a third completed well 82 that is positioned in close proximity to at least one of the completed wells 52 connected to the current generator 68. Since the third completed well 82 is in a region of the formation where current is present, there is the possibility that some current will flow on the third completed well 82, in returning to the surface. Let current on the third completed well 82 (e.g., the current on the casing of the third completed well 82) be denoted as −I"(z), and let the current returning on the second completed well 24 be −I'(z). The sum of the currents on the three completed wells 52 can be written as I(z)−I'(z)−I"(z)=0, where I(z) is the current on the first completed well 22.

While the first and second completed wells 22, 24 may be hardwired to the generator 68, the third completed well 82 may not be electrically connected to the generator 68. Hence, in the illustrated embodiment, the current on the third completed well 82 should be very small since the resistance between the third completed well 82 and the current generator 68 is large compared to that for the first and second completed wells 22, 24, which are driven wells, i.e. $|I''(z)| \ll |I'(z)|$. If there is a highly conductive layer 84 near the surface, then it may reduce the resistance between the third completed well 82 and the current generator 68. For this reason, it may be beneficial to use two wells that are closest to each other as the balanced pair. However, even in the situation depicted in FIG. 3, an exemplary embodiment may be employed with a correction made for the current on the third completed well 82.

In addition, the drill string 28 may provide an additional current return path to the surface, with a small amount of current flowing on the BHA 32. Again this should be a very small effect if the pair of completed wells 22, 24 is driven in a balanced mode. If desired, an insulating gap 86 can be added to the BHA 32 above the location of the at least one magnetometer 40, as illustrated in FIG. 3. The insulating gap 86 may inhibit current from flowing on the drill string 28.

The current distribution I(z) along the first and second completed wells 22, 24 may depend on a number of factors, including operating frequency, cement resistivity, casing contact impedance, formation resistivity, layering, and the presence of other casings. Since some of these effects cannot be measured, or has not been measured, the magnitude of the current at any depth z will not be known accurately a priori. As an example, consider two parallel completed wells with diameter d and separated by a distance S. Neglecting cement resistivity and frequency-dependent effects, the conductance per unit length ($\mathcal{G}$) between the two wells may be represented by the following equation:

$$\mathcal{G} = \frac{\pi}{R_f \cosh^{-1}(S/d)}, \tag{1}$$

where $R_f$ is the formation resistivity. Assuming a surface layer with resistivity $R_1$ and thickness $L_1$, and below that another layer with formation resistivity $R_2$, let the total depth of the two wells be $L_1+L_2$. For sufficiently low frequencies, the current I(z) will decrease linearly with depth in both regions.

Figure 4:
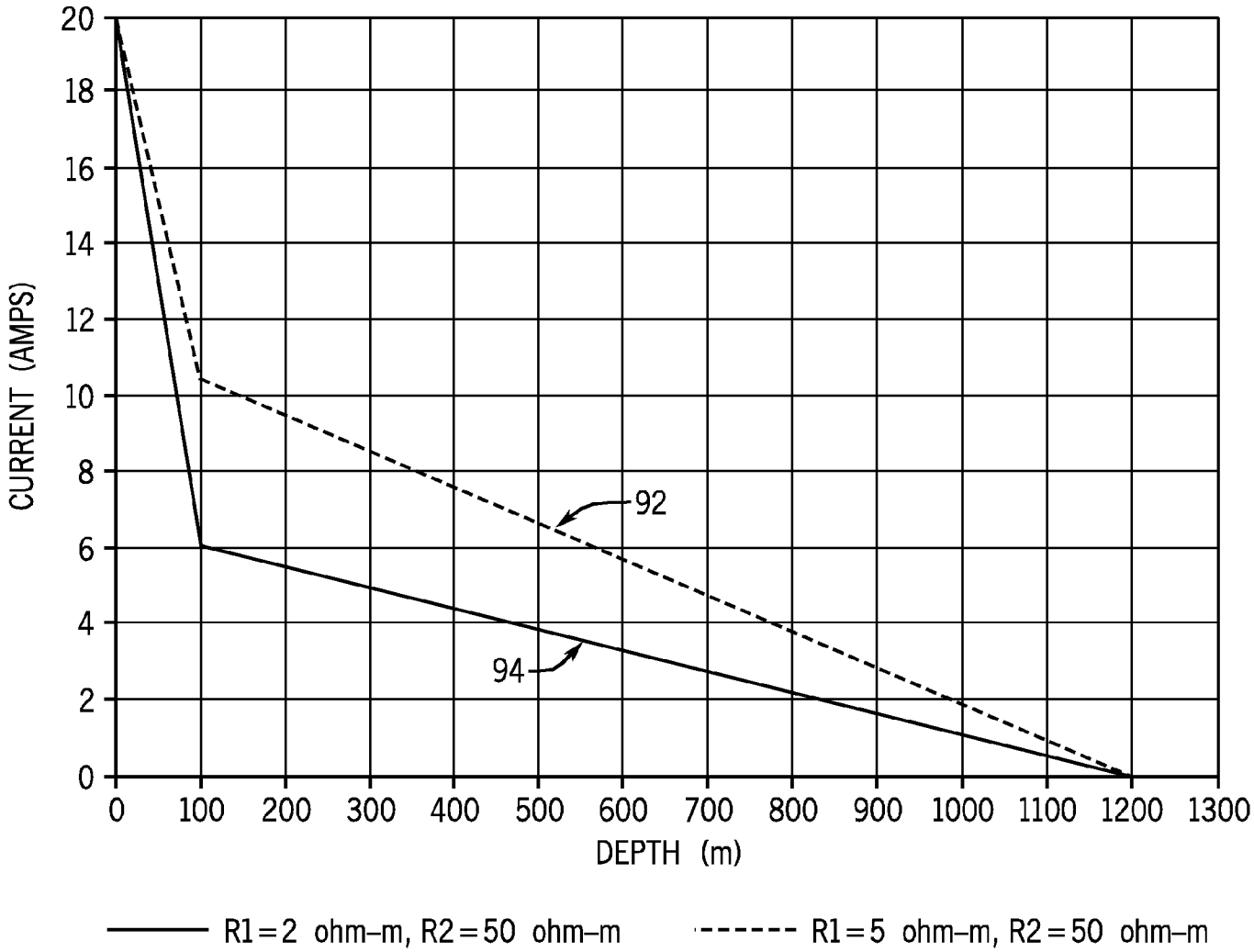
FIG. 4 includes a plot of current distribution versus depth for two examples in accordance with exemplary embodiments.

FIG. 4 is a representative plot of current distribution versus depth (z) for two scenarios in accordance with exemplary embodiments. Specifically, in FIG. 4, two cases are plotted to illustrate the sensitivity of downhole current amplitude to formation resistivity, wherein a first case is represented by plot 92 and a second case is represented by a plot 94. The common parameters in the two cases are: I(0)=20 amperes, $L_1$=100 m, $L_2$=1100 m, S=10 m, d=0.178 m, and $R_2$=50 ohm-m. The resistivity of the upper layer is $R_1$=5 ohm-m in the first case (plot 92) and $R_1$=2 ohm-m in the second case (plot 94). This difference in the upper layer resistivity results in a 40% change in the current amplitude in the lower formation. While the current and voltage at surface can be measured, the actual distribution of the current downhole cannot be determined without some additional, local downhole measurements. Hence, any uncertainties in the thickness or resistivity of various layers will result in uncertainty in the amplitude of the current. With the current's amplitude uncertain, the magnitude of any associated magnetic field will also be uncertain.

Figure 5:
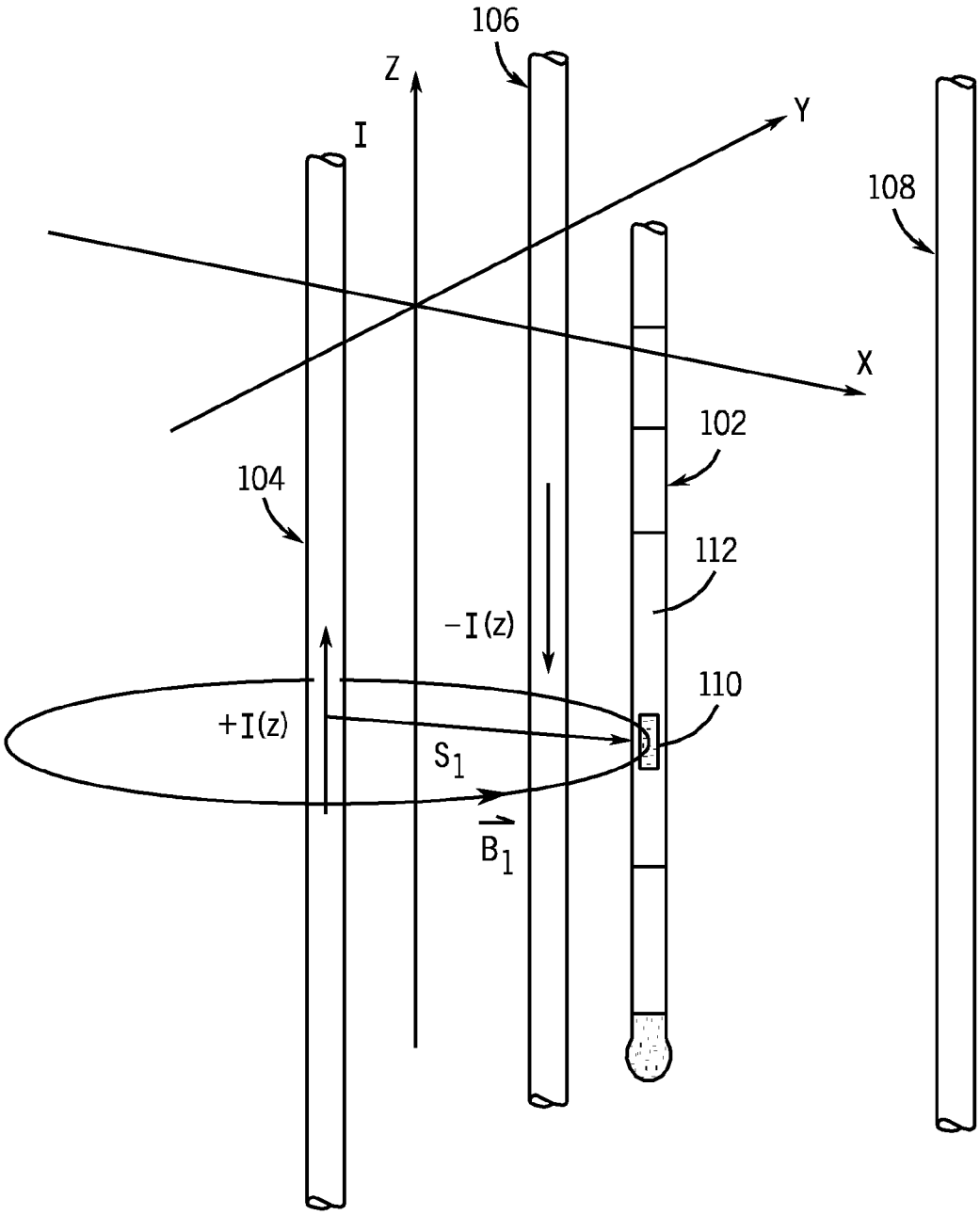
FIG. 5 includes a perspective view of geometry of a bottom hole assembly and three cased wells in accordance with an exemplary embodiment.

FIG. 5 is a perspective view of geometric relationships between a BHA 102, a first cased well 104, a second cased well 106, and a third cased well 108. Similarly, FIG. 6 includes two diagrams that are representative of geometric relationships between cross-sectional views of the BHA 102, and the three cased wells 104, 106, 108. The three cased wells 104, 106, and 108 may be representative of three wells in the array 14. Further, the casing may be replaced in some embodiments by a different conductive feature. In order to accurately determine the position of the BHA 102 with respect to the existing completed wells 104, 106, 108, one cannot simply use the magnitude of the magnetic field. Indeed, in view of such an approach, at any given depth, uncertainties in the amplitude of the current will introduce errors in the determined values associated with the position of the BHA 102. Therefore, the position of the BHA 102 must be determined without a foreknowledge of the amplitudes of the currents on the completed wells 104, 106, 108.

Figure 6:
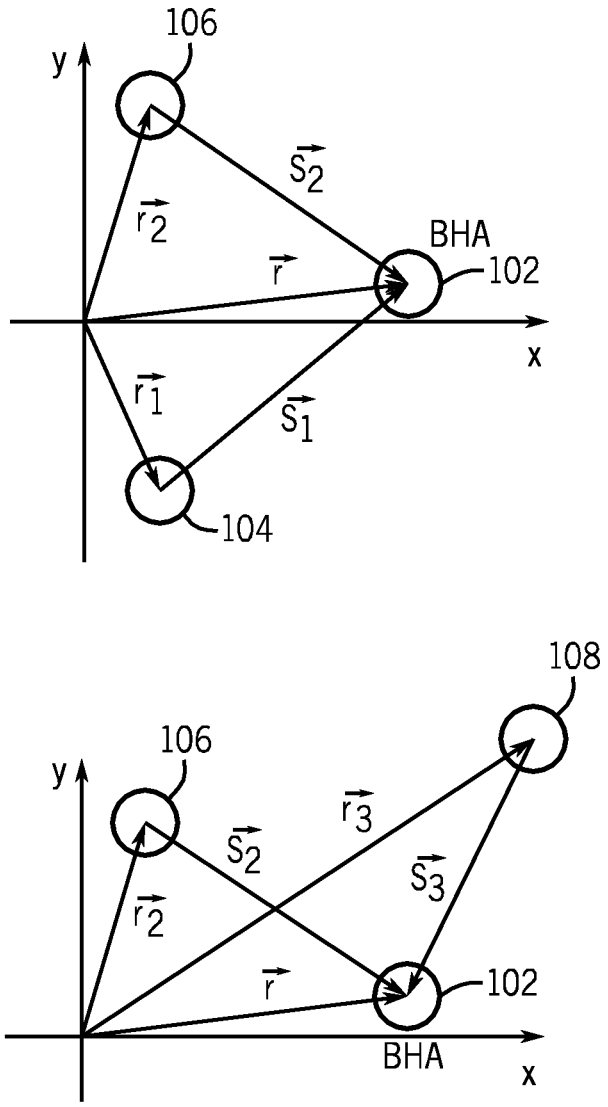
FIG. 6 includes a plan view of geometry of a bottom hole assembly and three cased wells in accordance with an exemplary embodiment.

As indicated above, referring to FIGS. 5 and 6, the geometry for the BHA 102 and three completed wells 104, 106, 108 are shown. In the illustrated embodiment, a magnetometer 110 (e.g., a 3-axis magnetometer) of the BHA 102 is located at $\vec{r}=x\hat{x}+y\hat{y}$. The $j^{th}$ completed well is located at $\vec{r}_j=x_j\hat{x}+y_j\hat{y}$; and the vector pointing from the $j^{th}$ completed well to the magnetometer is $\vec{S}_j=\vec{r}-\vec{r}_j=(x-x_j)\hat{x}+(y-y_j)\hat{y}$, where j=1, 2, 3. For example, the current on the $j^{th}$ completed well produces a magnetic field represented by the following equation:

$$\vec{B}_j(x, y, z) = \frac{\mu_0 I_j(z)}{2\pi S_j^2}\hat{z}\times\vec{S}_j, \tag{2}$$

where $\mu_0=4\pi\cdot10^{-7}$ Henry/m.

The total magnetic field for a pair of wells is the sum of individual fields. For example, with $I_1(z)=I(z)$ and $I_2(z)=-I(z)$ for the pair consisting of the first cased well 104 and the second cased well 106:

$$\begin{aligned}\vec{B}(x, y) &= \vec{B}_1(x, y, z) + \vec{B}_2(x, y, z) \\ &= B_x(x, y, z)\hat{x} + B_y(x, y, z)\hat{y},\end{aligned} \tag{3}$$

where $$B_x(x, y, z) = -\frac{\mu_0 I(z)}{2\pi}\frac{(y-y_1)}{(x-x_1)^2+(y-y_1)^2} + \frac{\mu_0 I(z)}{2\pi}\frac{(y-y_2)}{(x-x_2)^2+(y-y_2)^2}, \tag{4}$$

$$B_y(x, y, z) = \frac{\mu_0 I(z)}{2\pi}\frac{(x-x_1)}{(x-x_1)^2+(y-y_1)^2} - \frac{\mu_0 I(z)}{2\pi}\frac{(x-x_2)}{(x-x_2)^2+(y-y_2)^2}. \tag{5}$$

For low enough frequencies, the resulting magnetic field will penetrate an outer portion of the BHA 102 (e.g., a drill collar of the measurement sub), and can be accurately measured with the magnetometer 110. In a general case, the BHA 102 may not be parallel to the completed well (e.g., completed wells 104, 106, 108), so that the axes of the magnetometer 110 may not be the same as the completed well. However, the magnetometer axes may be mathematically rotated to correspond to the x-y-z coordinate system defined by the casing direction. This can be done with data provided by direction and inclination sensors of a MWD tool 112, and with knowledge of the completed well direction and inclination. Henceforth, discussion may be based on an assumption that the magnetometer readings have been rotated into the x-y-z coordinate system.

Figure 7:
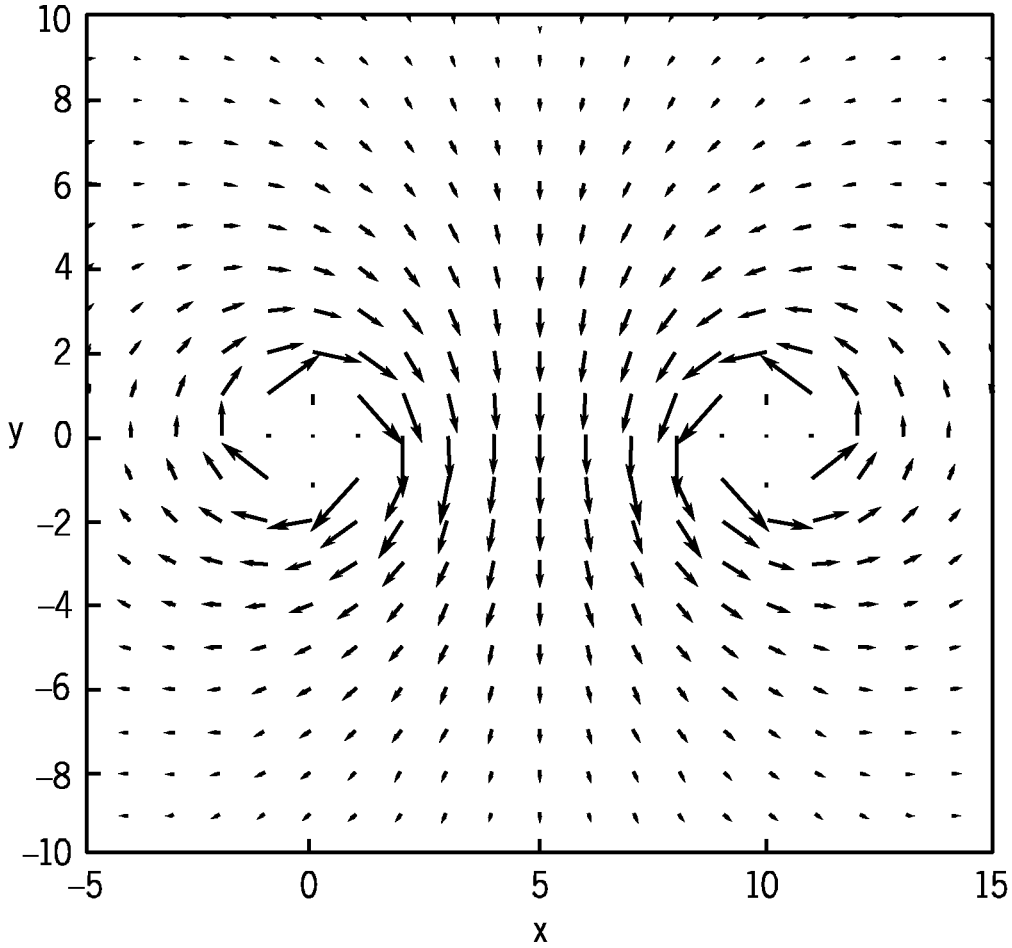
FIG. 7 includes a vector plot of magnetic fields for two cased wells in accordance with an exemplary embodiment.

A specific example is now given for the magnetic field produced per 1 amp current at depth (e.g. I(z)=1 amp at z=1100 m from FIG. 4). Referring to FIG. 2, the two completed wells 22, 24 may be located at $(x_1, y_1)=(0, 0)$ and $(x_2, y_2)=(10, 0)$, where distances are in meters unless otherwise specified. This corresponds to the two wells **12*e* and 12*h*** shown in FIG. 1. Using these values, a vector representation of the magnetic field may be plotted in the x-y plane, as illustrated by the plot in FIG. 7. The direction of the magnetic field varies depending on the point of observation. For example, along the line defined by x=5, the magnetic field points in the negative y direction corresponding to current flowing upwards on the second completed well 12*h* and downwards on the first completed well 12*e*. A half-cycle later, the directions of the currents reverse as does the magnetic field. While the magnetic field measurements are made by the MWD tool, the phase of the currents on the completed wells 12*e*, 12*h* will generally not be known. Hence, there is a 180° ambiguity in the magnetic field direction. The angle of the magnetic field can be computed from the magnetic field components, $B_x(x, y, z)$ and $B_y(x, y, z)$:

$$\theta(x,y,z)=\tan^{-1}(B_y(x,y,z)/B_x(x,y,z)). \tag{6}$$

Figure 8:
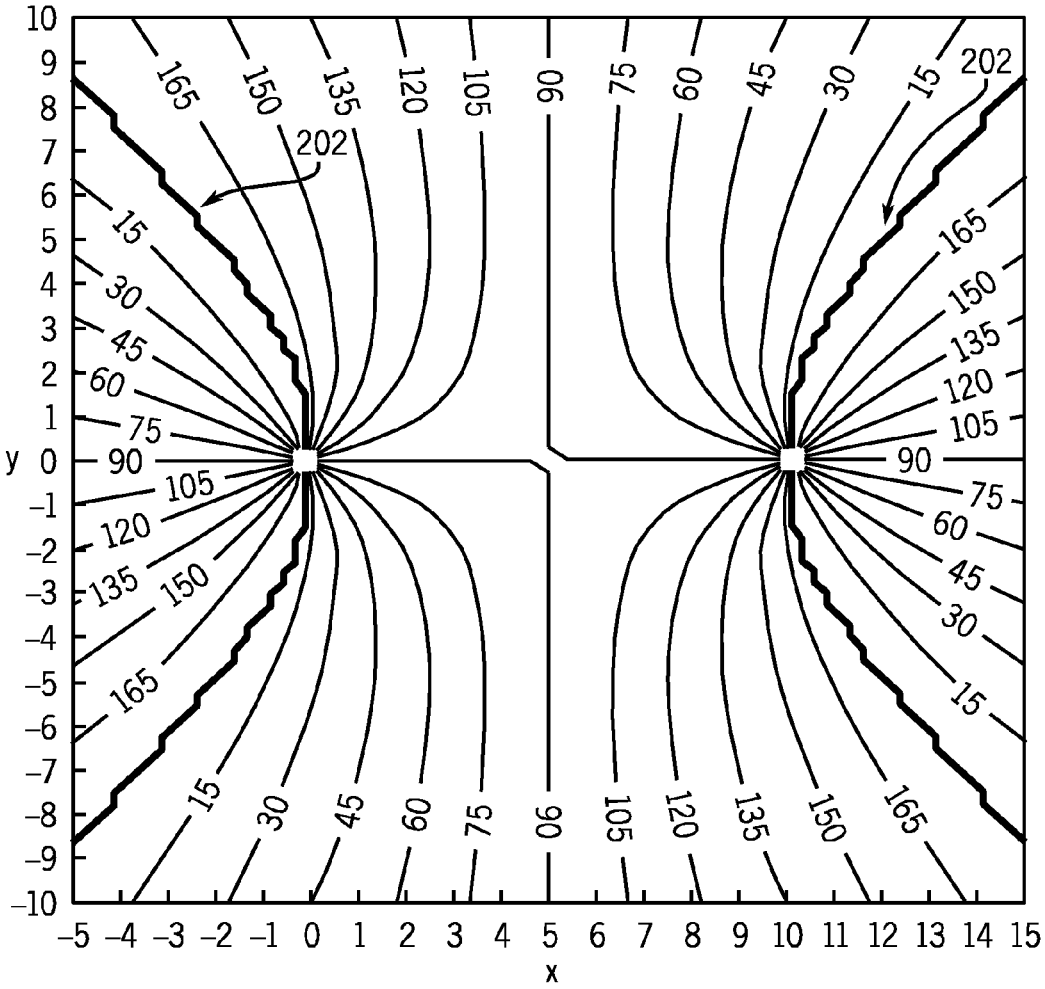
FIG. 8 includes a magnetic field direction contour plot for two cased wells in accordance with an exemplary embodiment.

The angles obtained from substituting values computed with equations (4) and (5) into equation (6) are plotted in FIG. 8. Specifically, FIG. 8 includes a magnetic field direction contour plot for two cased wells at $(x_1, y_1)=(0, 0)$ and $(x_2, y_2)=(10, 0)$, wherein the units are degrees. Referring to FIG. 8, contour lines of constant angle θ are shown. Two heavy lines 202 in FIG. 8 correspond to branch cuts for the inverse tangent function, which occur at 0°/180°. Note also that the inverse tangent function returns an angle modulo 180°, so that the direction of the magnetic field given by equation (6) is indeterminate by 180°.

In practical terms, the 180° ambiguity does not cause issues. Indeed, the MWD direction and inclination sensors, or previous position measurements, should provide sufficient accuracy to determine the approximate location of the BHA 32, and, thus, the well being drilled 26, with respect to the completed wells 22, 24. For example, referring to FIG. 8, knowledge of whether the BHA 32 is above the pair of completed wells (y>0), or below them (y<0) may be sufficient to resolve the 180° ambiguity.

Figure 9:
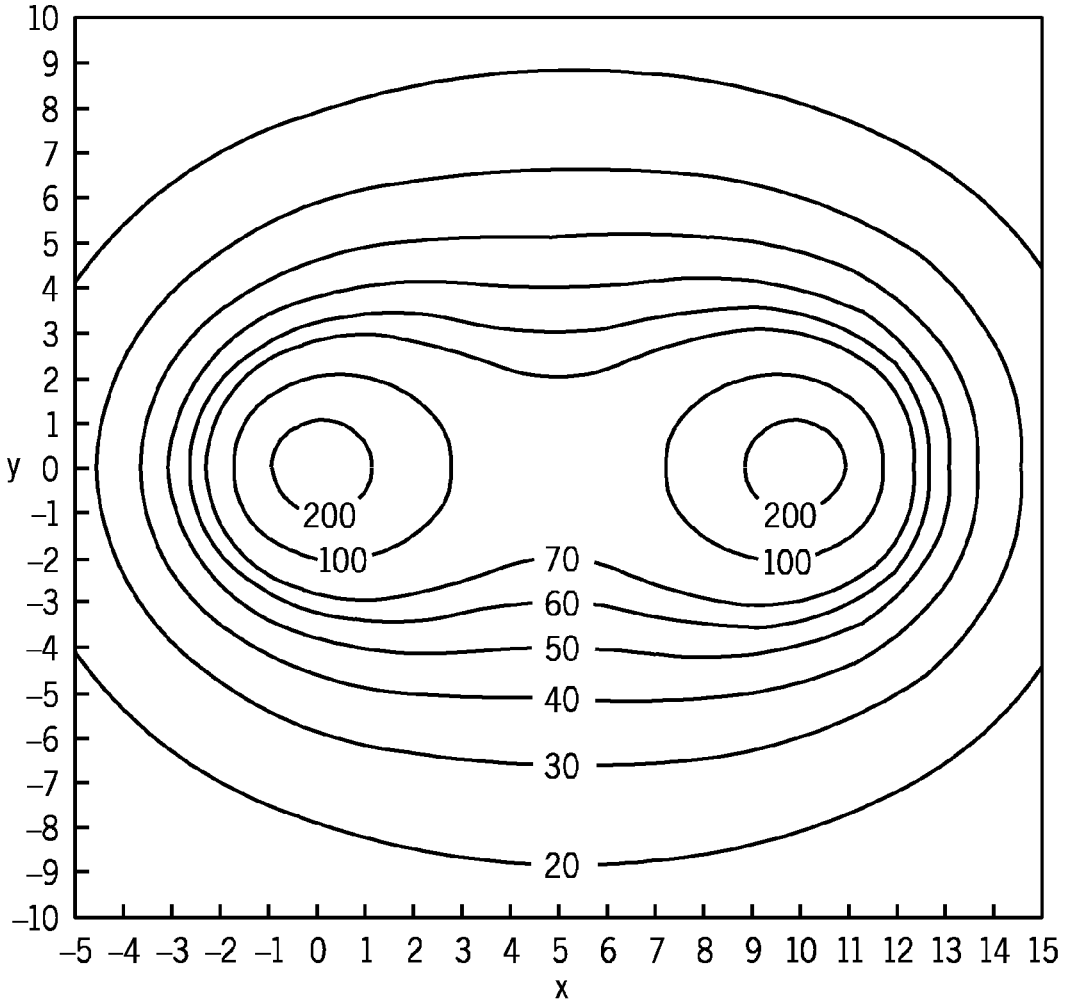
FIG. 9 includes a field amplitude contour plot for two cased wells in accordance with an exemplary embodiment.

FIG. 9 includes a magnetic field amplitude contour plot for two cased wells at $(x_1, y_1)=(0, 0)$ and $(x_2, y_2)=(10, 0)$, wherein the units are nanoTesla per ampere. Specifically, FIG. 9 shows the absolute magnitude of the magnetic field, $B_t(x, y, z)$, where $$B_t(x, y, z) = |B_x(x, y, z)\hat{x} + B_y(x, y, z)\hat{y}|, \tag{7}$$

$$B_t(x, y, z) = \sqrt{(B_x(x, y, z))^2 + (B_y(x, y, z))^2}$$

As indicated above, the values of contour lines in FIG. 9 are shown in units of nanoTesla per 1 ampere current.

Figure 10:
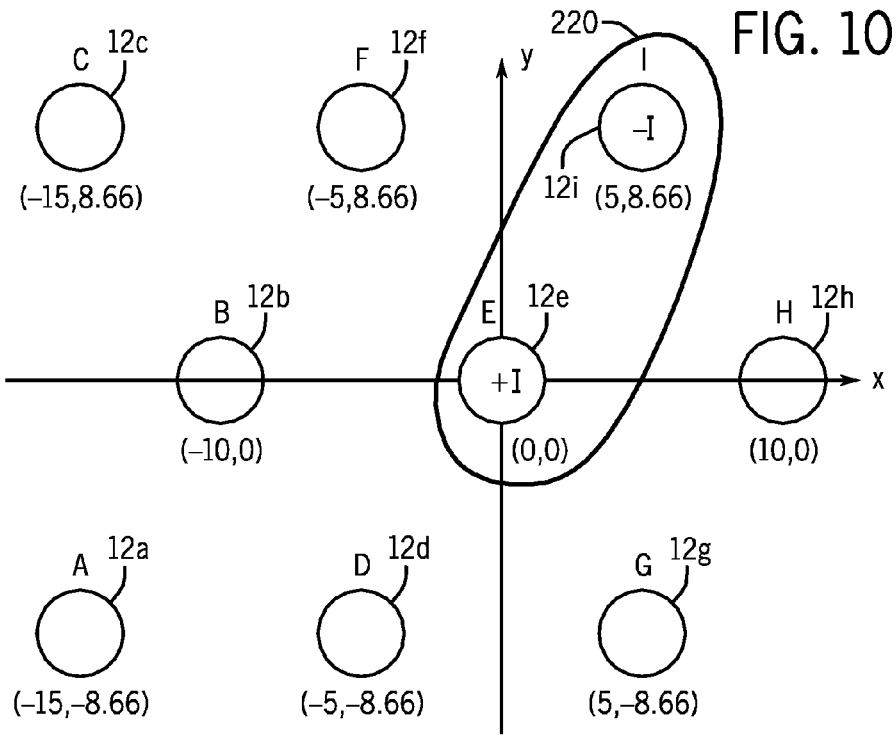
FIGS. 10 and 11 include plan views of an array of wells in accordance with an exemplary embodiment.
Figure 11:
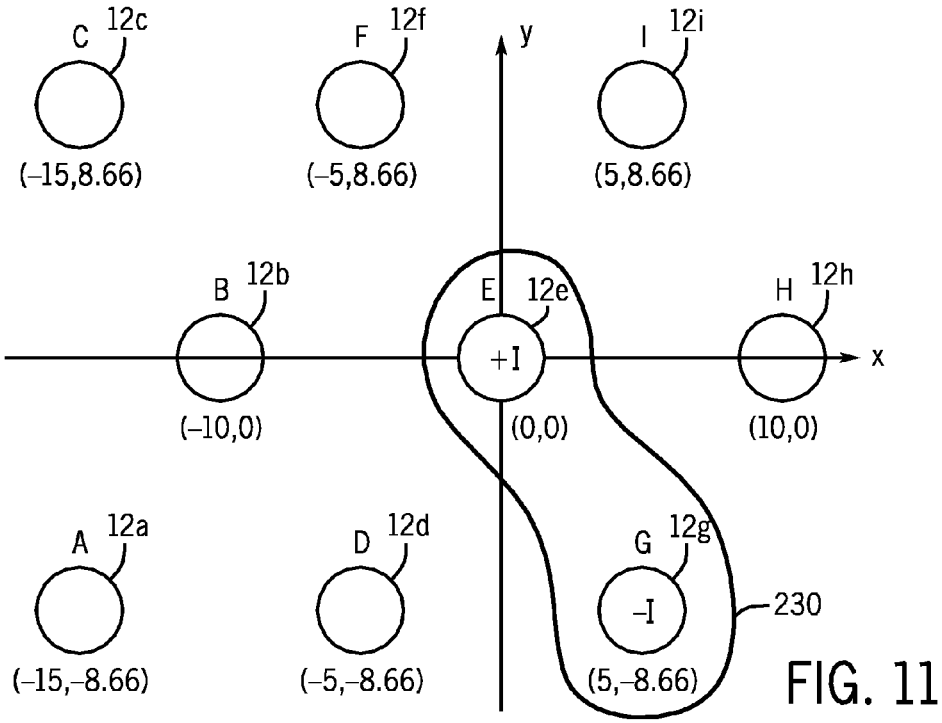

A method in accordance with an exemplary embodiment may be demonstrated with the well pattern 14 shown in FIG. 1. The approach may involve drilling a series of wells progressing in a direction. For example, a series of wells may be drilled from left to right (i.e. the direction is along the positive x axis). In a specific example, it may be assumed that wells 12*a*, 12*b*, 12*c*, 12*d*, 12*e*, 12*f*, and 12*i* have been drilled and completed with conductive tubulars. In accordance with one embodiment, the next well to be drilled in the sequence is well 12*h*, located at (x, y)=(10, 0). This is the status of the pattern 14 as it is illustrated in FIGS. 10 and 11.

The strategy may be to drive two well pairs with balanced currents. A first well pair 220 may consist of wells 12*e* and 12*i*, as shown in FIG. 10. The location of well 12*e* may be known, e.g. $(x_1, y_1)=(0, 0)$, and the location of well 12*i* may also be known, e.g. $(x_2, y_2)=(5, 8.66)$. A second well pair 230 may consist of wells 12*e* and 12*g*, as shown in FIG. 11. The location of well 12*g* may also be known, e.g. $(x_3, y_3)=(5, -8.66)$. An object in accordance with an exemplary embodiment may be to determine the location of the BHA for the well being drilled (e.g., well 12*h*) given the known locations of the three wells 12*e*, 12*g*, and 12*i*.

Figure 12:
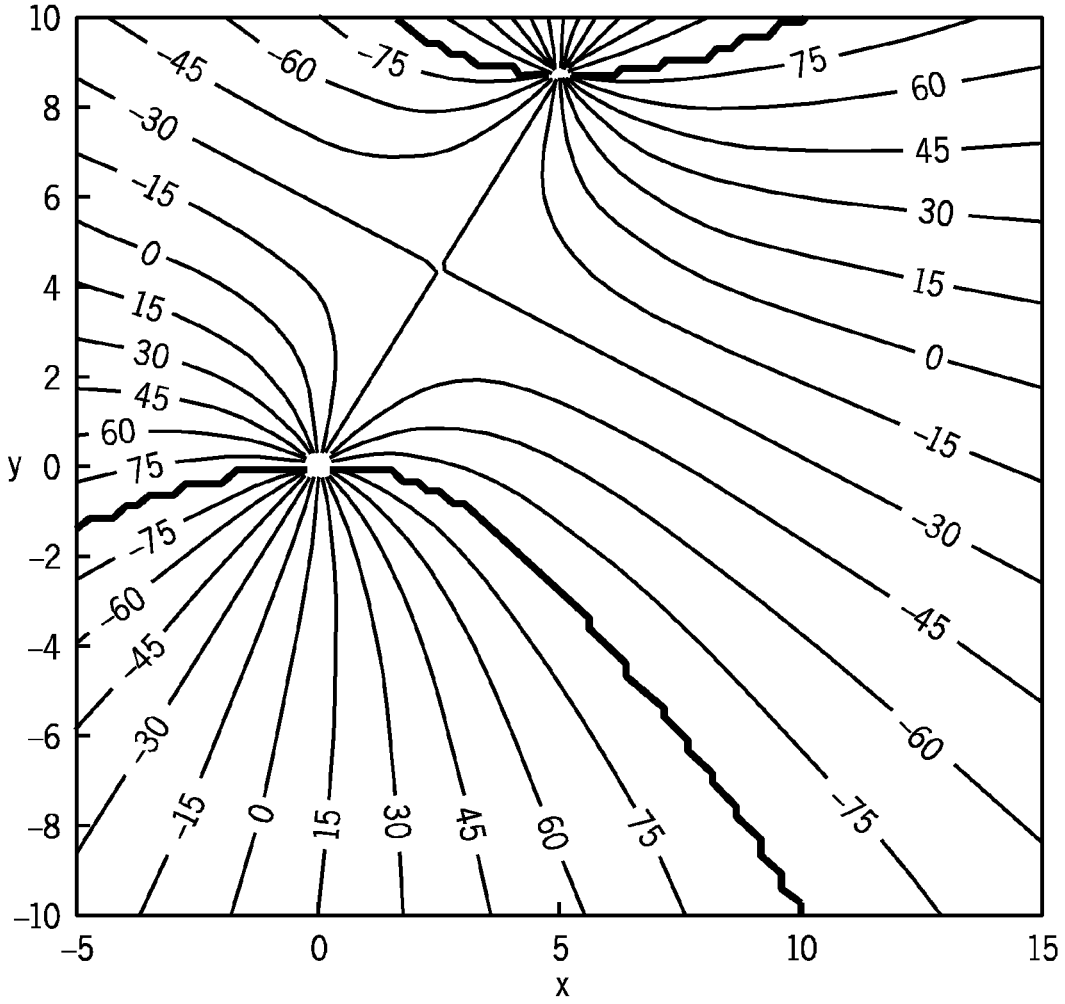
FIG. 12 includes a contour plot of a magnetic field direction for a well pair in accordance with an exemplary embodiment.

FIG. 12 includes a contour plot of a magnetic field direction $\theta_1(x, y)$ for the first well pair 220 in accordance with an exemplary embodiment. The first well pair 220 may be driven with balanced currents to produce the magnetic field downhole, which may be measured by a three-axis magnetometer in a BHA being utilized to drill the well 12*h*. FIG. 12 shows the direction of the magnetic field obtained from equation (6) for the first pair of wells. The direction of the magnetic field is $$\theta_1(x,y,z)=\tan^{-1}(B_{1y}(x,y,z)/B_{1x}(x,y,z)), \tag{8}$$

and the magnitude of the magnetic field is $$B_{1t}(x,y,z)=\sqrt{(B_{1x}(x,y,z))^2+(B_{1y}(x,y,z))^2} \tag{9}$$

The subscript "1" refers to the first well pair 220.

Figure 13:
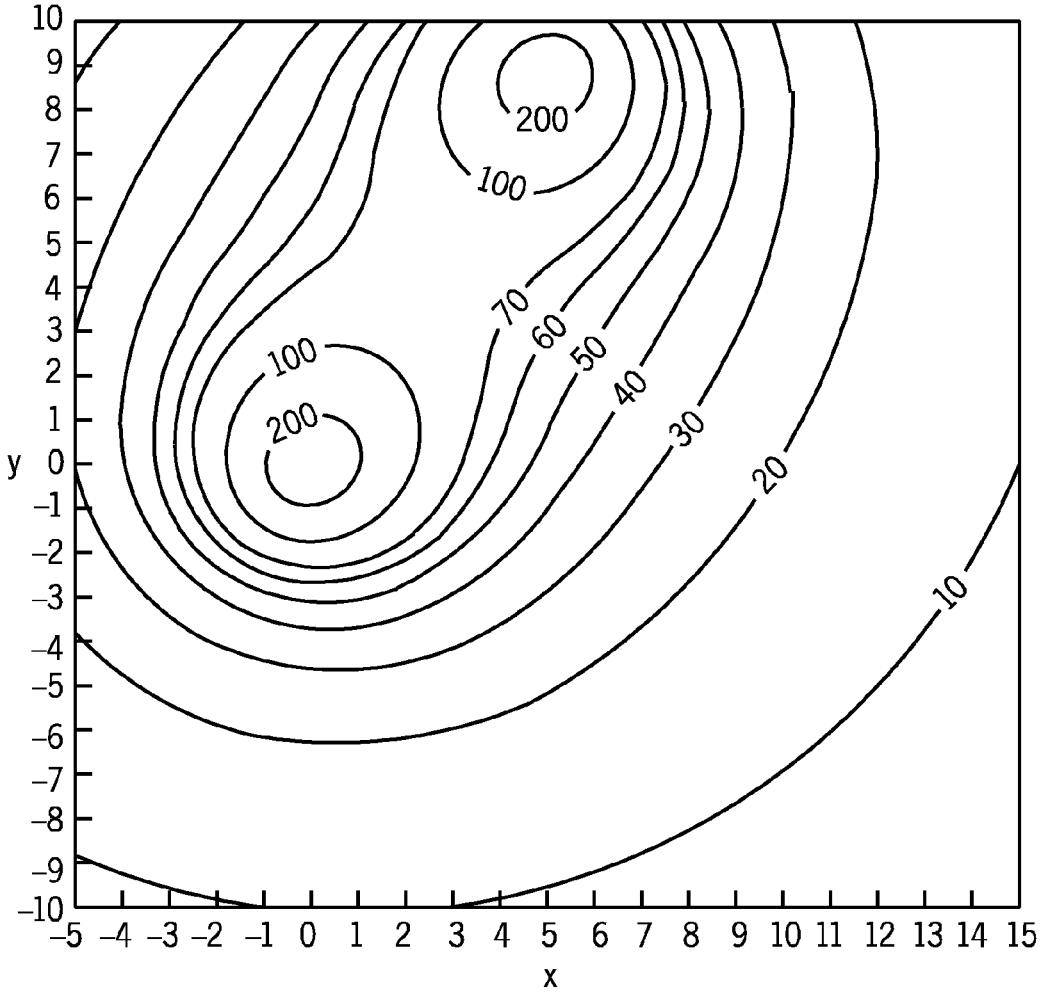
FIG. 13 includes a contour plot of a magnetic field amplitude for a well pair in accordance with an exemplary embodiment.
Figure 14:
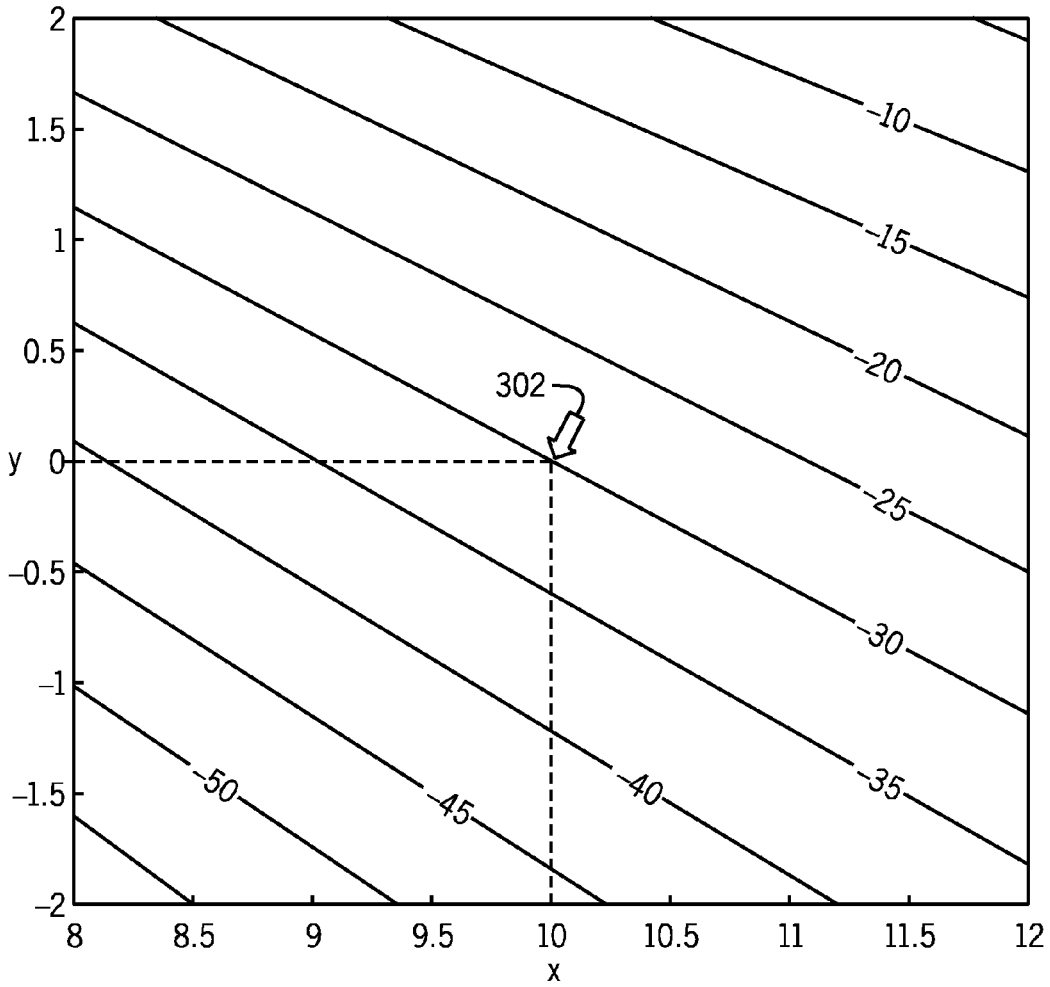
FIG. 14 includes a contour plot of a magnetic field direction for a well pair in accordance with an exemplary embodiment.
Figure 15:
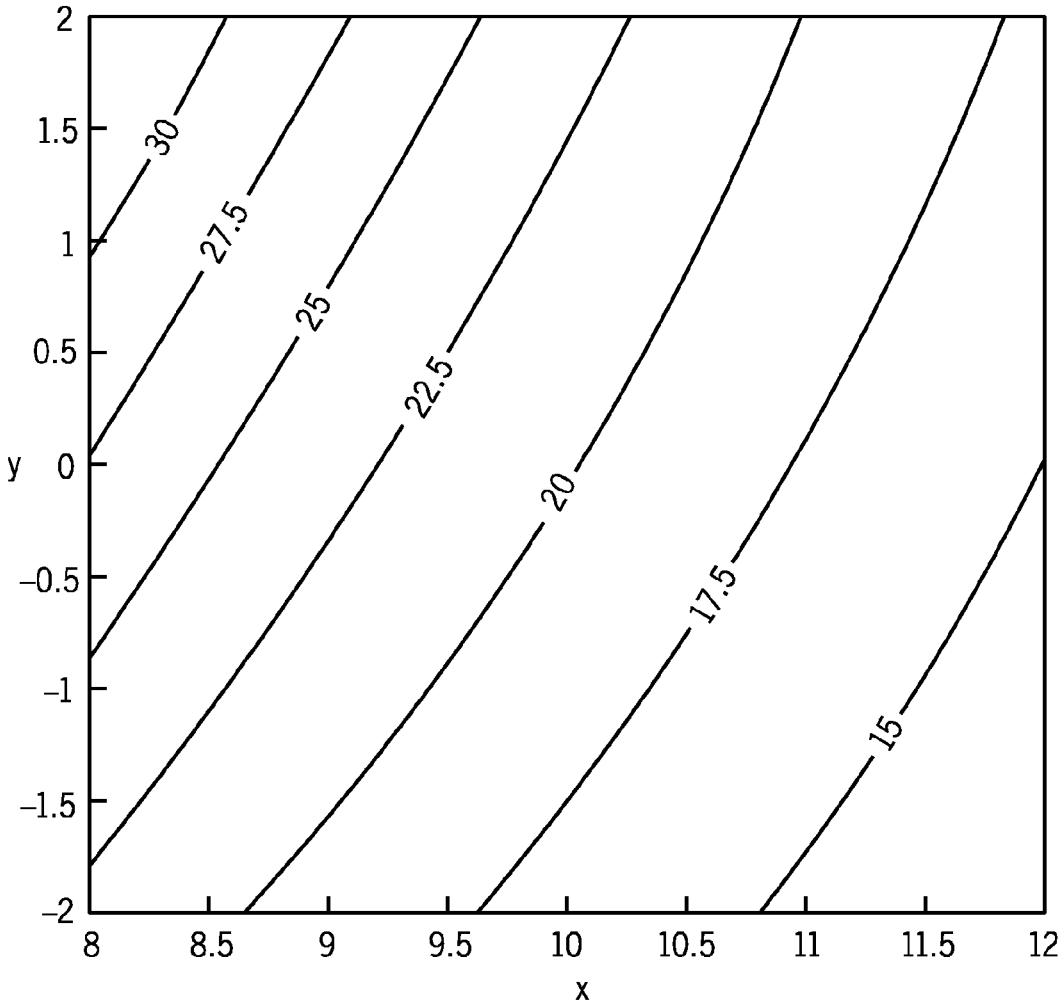
FIG. 15 includes an expanded contour plot of magnetic field amplitude for a well pair in accordance with an exemplary embodiment.

The absolute magnitude of the magnetic field represented in FIG. 12 is shown in FIG. 13. Specifically, FIG. 13 includes a contour plot of magnetic filed amplitude for a first well pair 220 with contour lines in units of nanoTesla per ampere. FIGS. 14 and 15 include expanded contour plots of the magnetic field direction and amplitude near the desired location for well 12*h*, i.e. in the proximity of (x, y)=(0,10). It should be noted that hereafter, the argument (x, y, z) will be suppressed in the notation, but should be understood.

Figure 16:
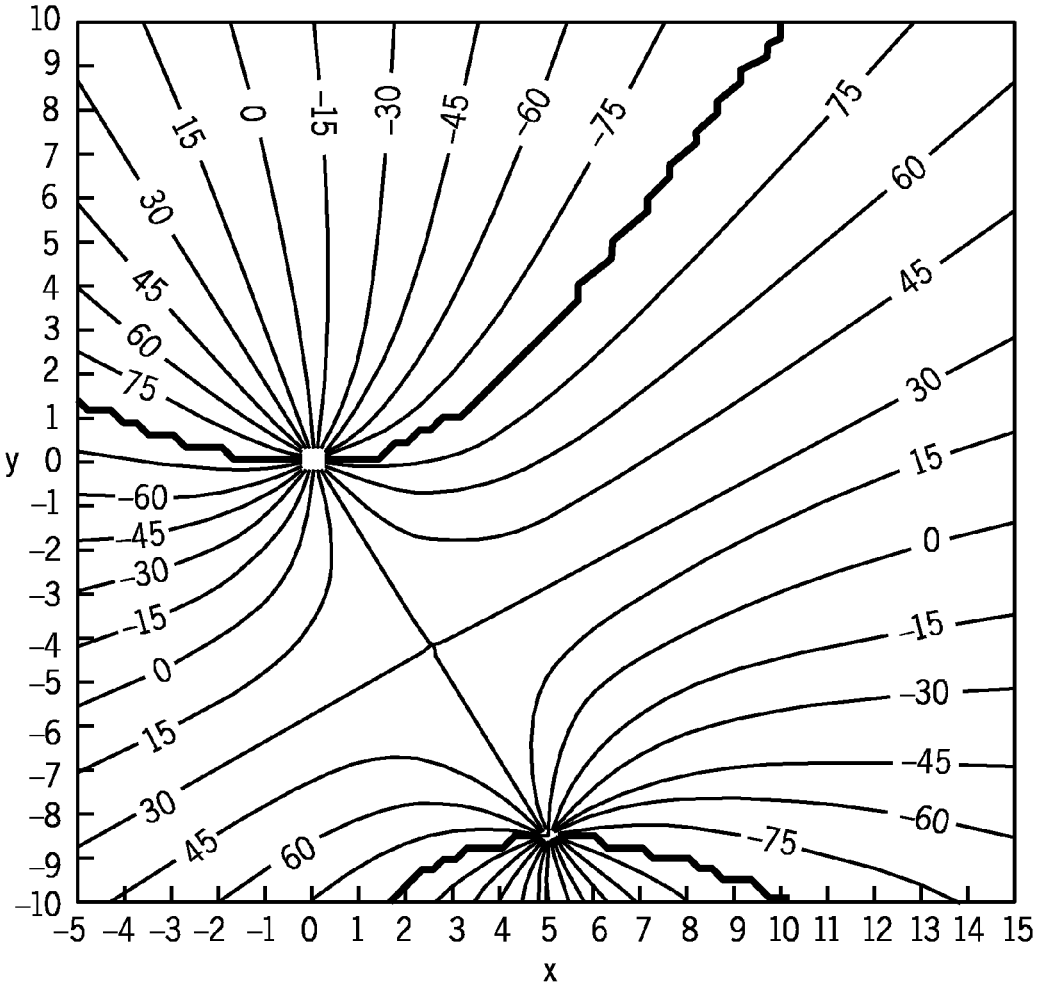
FIG. 16 includes a contour plot of a magnetic field direction for a well pair in accordance with an exemplary embodiment.
Figure 17:
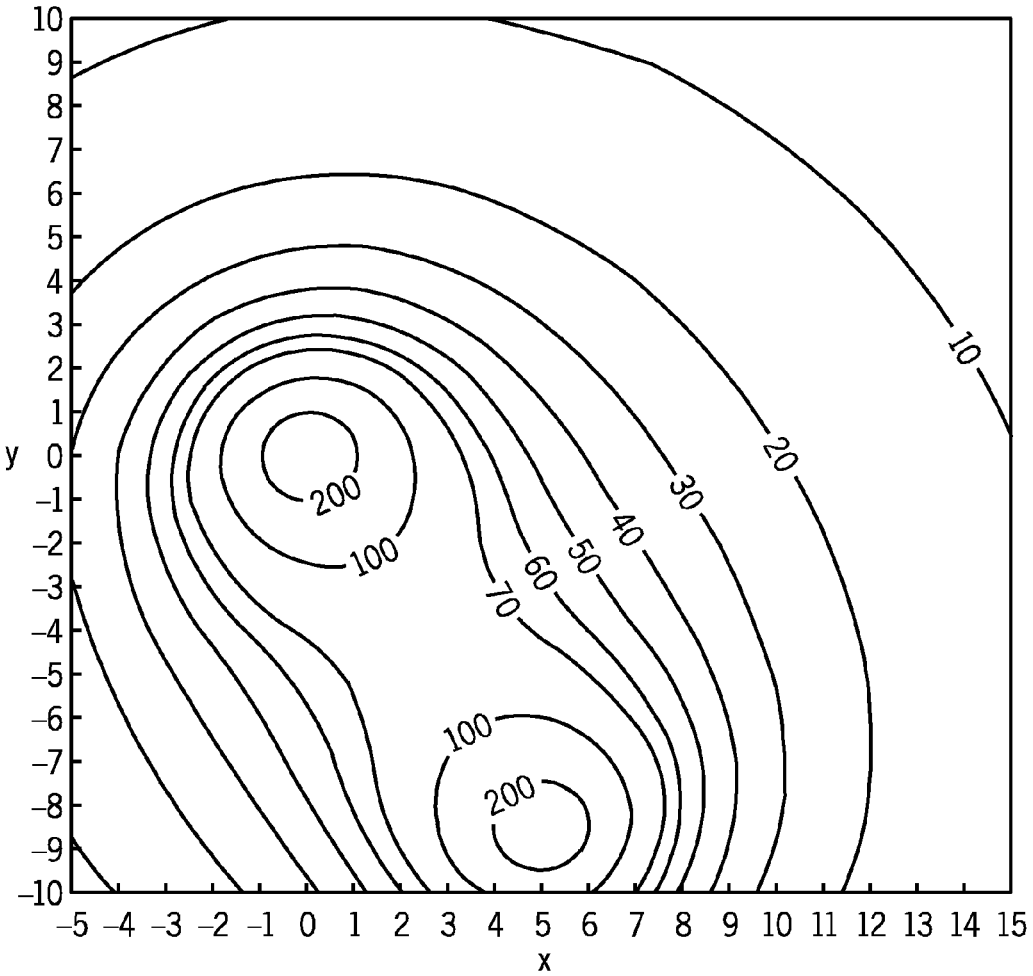
FIG. 17 includes a contour plot of a magnetic field amplitude for a well pair in accordance with an exemplary embodiment.
Figure 18:
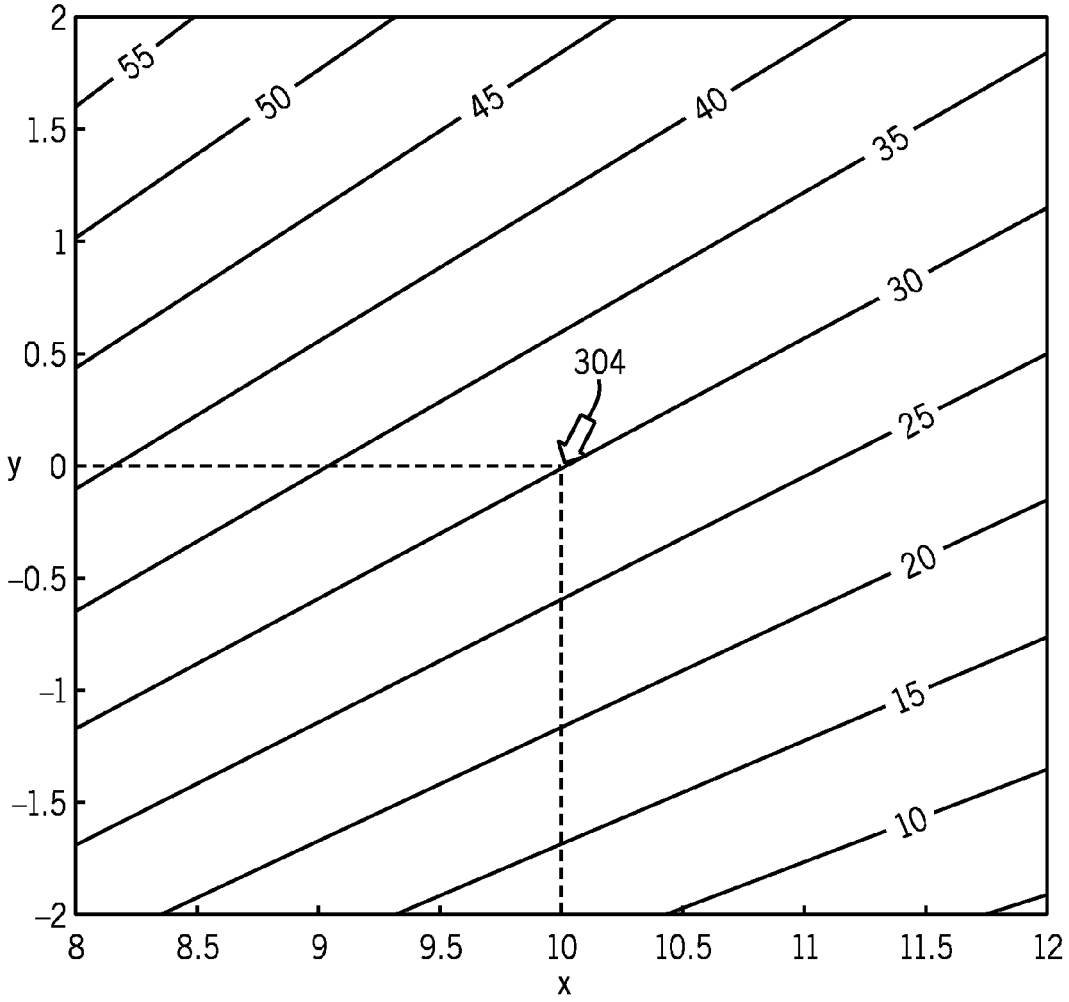
FIG. 18 includes an expanded contour plot of a magnetic field direction for a well pair in accordance with an exemplary embodiment.
Figure 19:
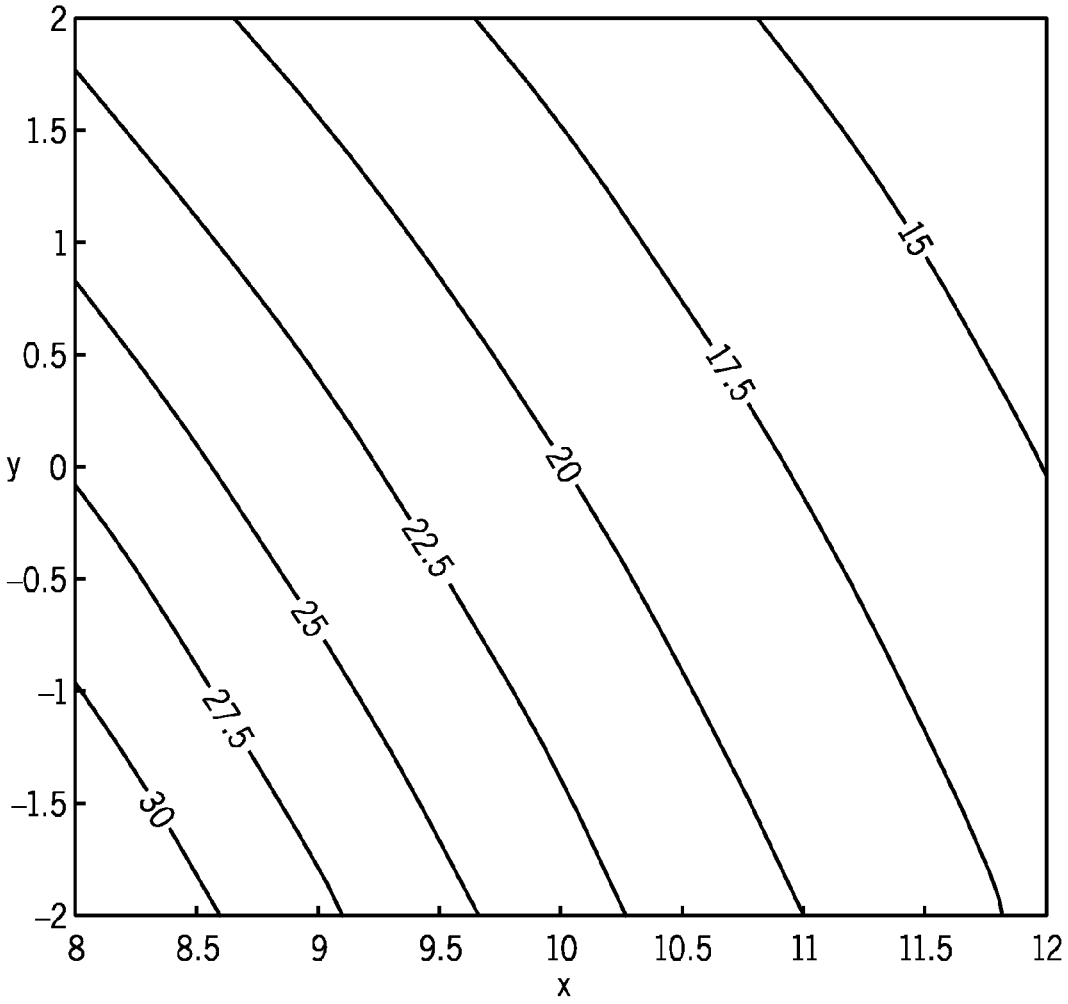
FIG. 19 includes an expanded contour plot of a magnetic field amplitude in accordance with an exemplary embodiment.

Now balanced currents may be applied to the second pair 230 (i.e., wells 12*e* and 12*g*) instead of to the first well pair 220. The magnetic field components may be $B_{2x}$ and $B_{2y}$. The magnetic field direction may be given by $\theta_2=\tan^{-1}(B_{2y}/B_{2x})$ and the magnitude may be given by $B_{2t}=\sqrt{(B_{2x})^2+(B_{2y})^2}$, where the subscript "2" refers to the second well pair 230. FIGS. 16 and 17 are contour plots for the direction and amplitude of the magnetic field. FIGS. 18 and 19 are expanded contour plots of the magnetic field direction and amplitude near the desired location for well 12*h* at (x, y)=(10, 0).

Because the magnetic field direction is independent of the current amplitudes, the angles $\theta_1$ and $\theta_2$ can be used to determine the BHA's position. Comparing FIG. 14 and FIG. 18, one observes that the contour lines are at an angle of approximately 60° with respect to each other. With the first well pair 220 activated, the field direction is −30° at (x, y)=(10, 0), as illustrated by indicator 302 in FIG. 14. With the second well pair 230 activated, the field direction is +30° at (x, y)=(10, 0), as illustrated by indicator 304 in FIG. 18. In both cases, a change of 5° normal to the contour lines corresponds to approximately 0.5 m displacement from (x, y)=(10, 0).

To distinguish between representation of measured quantities and representation of quantities calculated from the theoretical model (e.g., calculated from equations (1) through (9)), all representations of measured quantities are indicated herein by a tilde. For example, $\theta_1(x, y, z)$ indicates the angle calculated using equation (8) with theoretical values for $B_{1x}(x, y, z)$ and $B_{1y}(x, y, z)$. A three-axis magnetometer in a measurement sub of a BHA being used to drill well 12*h* may measure magnetic field components $\tilde{B}_{\tilde{1}\tilde{x}}$ and $\tilde{B}_{\tilde{1}\tilde{y}}$, from which $\tilde{\theta}_{\tilde{1}}=\tan^{-1}(\tilde{B}_{\tilde{1}\tilde{y}}/\tilde{B}_{\tilde{1}\tilde{x}})$ is obtained. Normally, the BHA will be stationary during the time $\tilde{B}_{\tilde{1}\tilde{x}}$ and $\tilde{B}_{\tilde{1}\tilde{y}}$ are measured.

Figure 20:
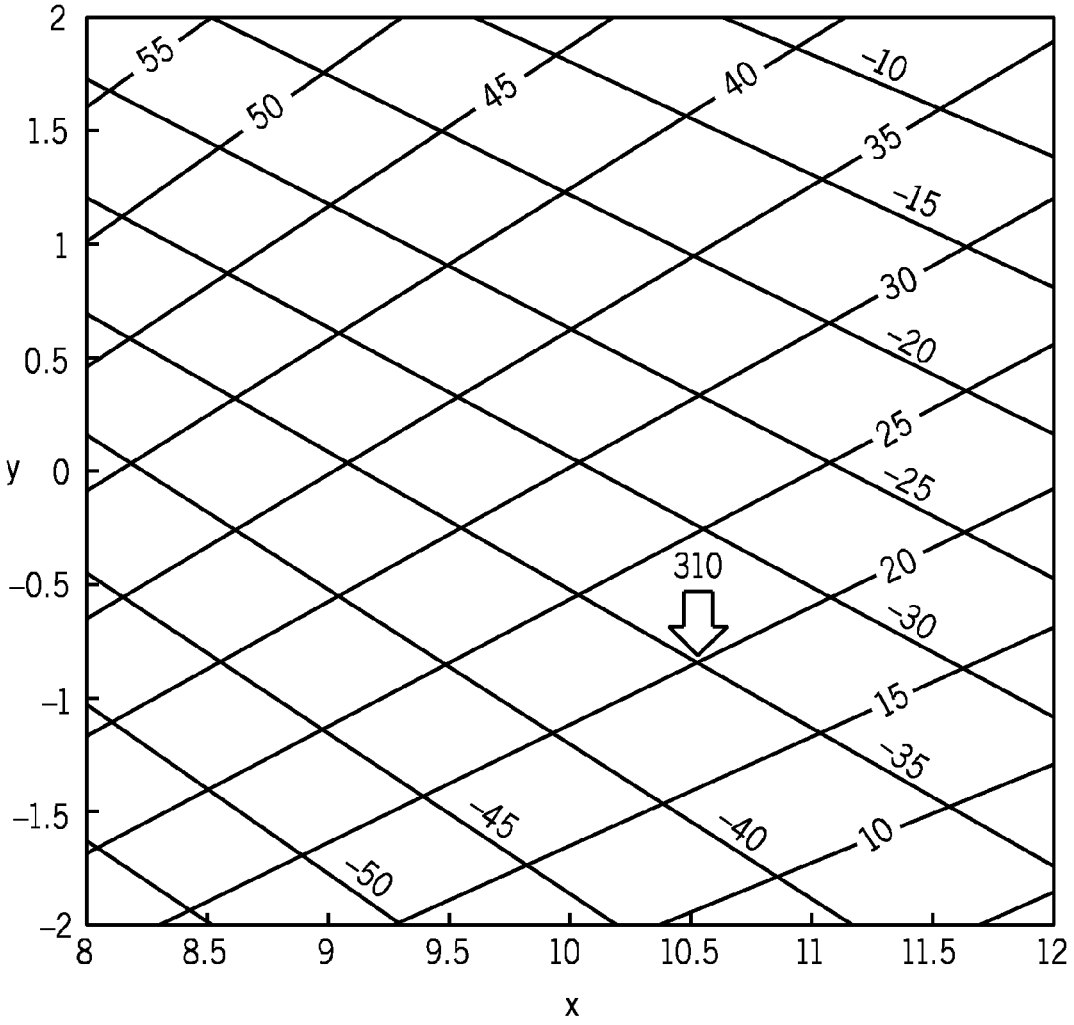
FIG. 20 includes a combination of FIGS. 14 and 18 and illustrates intersecting contour lines in accordance with an exemplary embodiment.

To determine the (x, y) position of the BHA, the measured angles $\tilde{\theta}_{\tilde{1}}$ and $\tilde{\theta}_{\tilde{2}}$ can be plotted on FIGS. 14 and 18. Each angle corresponds to a contour line, and the intersection of the two contour lines indicates the BHA's position in the x-y plane. This can be done graphically. For example, in one embodiment, measured values for magnetic fields may result in angles $\tilde{\theta}_1=-35°$ and $\tilde{\theta}_2=20°$. The contour lines computed for $\theta_1=-35$ and $\theta_2=20$ intersect approximately at (x, y)=(10.5, −0.8), which can be determined by overlaying FIGS. 14 and 18. Indeed, FIG. 20 represents a combination of FIGS. 14 and 18, wherein the intersection of contour lines computed for $\theta_1=-35$ and $\theta_2=20$ is designated by an indicator 310, as an example. Specifically, the indicator 310 is pointing to an intersection between the relevant contour lines where the coordinate values are approximately (x, y)=(10.5, −0.8).

In one embodiment, tables may be created from the known positions of wells 12*e*, 12*g*, and 12*i*, as illustrated by Tables I and II set forth below. Table I includes magnetic field direction $\theta_1(x, y)$ for the first well pair 220 (i.e., well 12*e* and well 12*i*) versus x and y, and Table II includes magnetic field direction $\theta_2(x, y)$ for the second well pair 203 (i.e., well 12*e* and well 12*g*) versus x and y. In an exemplary embodiment, the values in the tables that correspond most closely to the measured values discussed above are located in both tables within a short distance of (x, y)=(10.50, −0.75).

TABLE I

| | x = 9.00 | 9.25 | 9.50 | 9.75 | 10.00 | 10.25 | 10.50 | 10.75 | 11.00 |
|---|---|---|---|---|---|---|---|---|---|
| y = 1.00 | −26.1° | −24.8° | −23.6° | −22.3° | −21.2° | −20.0° | −18.9° | −17.8° | −16.7° |
| 0.75 | −28.4° | −27.1° | −25.8° | −24.6° | −23.4° | −22.2° | −21.1° | −20.0° | −18.9° |
| 0.50 | −30.7° | °29.4° | −28.1° | −26.9° | −25.6° | −24.5° | −23.3° | −22.2° | −21.1° |
| 0.25 | −33.0° | −31.6° | −30.3° | −29.1° | −27.8° | −26.6° | −25.5° | −24.3° | −23.2° |
| 0.00 | −35.2° | −33.9° | −32.5° | −31.3° | −30.0° | −28.8° | −27.6° | −26.4° | −25.3° |
| −0.25 | −37.4° | −36.0° | −34.7° | −33.4° | −32.1° | −30.9° | −29.7° | −28.5° | −27.3° |
| −0.50 | −39.6° | −38.2° | −36.8° | −35.5° | −34.2° | −33.0° | −31.7° | −30.5° | −29.4° |
| −0.75 | −41.7° | −40.3° | −39.0° | −37.6° | −36.3° | −35.0° | −33.8° | −32.6° | −31.4° |
| −1.00 | −43.8° | −42.4° | −41.0° | −39.7° | −38.3° | −37.0° | −35.8° | −34.6° | −33.3° |

TABLE II

| | x = 9.00 | 9.25 | 9.50 | 9.75 | 10.00 | 10.25 | 10.50. | 10.75 | 11.00 |
|---|---|---|---|---|---|---|---|---|---|
| y = 1.00 | 43.8° | 42.4° | 41.0° | 39.7° | 38.3° | 37.0° | 35.8° | 34.6° | 33.3° |
| 0.75 | 41.7° | 40.3° | 39.0° | 37.6° | 36.3° | 35.0° | 33.8° | 32.6° | 31.4° |
| 0.50 | 39.6° | 38.2° | 36.8° | 35.5° | 34.2° | 33.0° | 31.7° | 30.5° | 29.4° |
| 0.25 | 37.4° | 36.0° | 34.7° | 33.4° | 32.1° | 30.9° | 29.7° | 28.5° | 27.3° |
| 0.00 | 35.2° | 33.9° | 32.5° | 31.3° | 30.0° | 28.8° | 27.6° | 26.4° | 25.3° |
| −0.25 | 33.0° | 31.6° | 30.3° | 29.1° | 27.8° | 26.6° | 25.5° | 24.3° | 23.2° |
| −0.50 | 30.7° | 29.4° | 28.1° | 26.9° | 25.6° | 24.5° | 23.3° | 22.2° | 21.1° |
| −0.75 | 28.4° | 27.1° | 25.8° | 24.6° | 23.4° | 22.2° | 21.1° | 20.0° | 18.9° |
| −1.00 | 26.1° | 24.8° | 23.6° | 22.3° | 21.2° | 20.0° | 18.9° | 17.8° | 16.7° |

In one embodiment, an algorithm may be used to determine the location of the BHA. An algorithm may be beneficial because it can be performed automatically by a processor, thus eliminating certain forms of human intervention. For example, consider the BHA to be located at the unknown position (x, y), and consider the measured angles to be $\tilde{\theta}_1$ and $\tilde{\theta}_2$. The processor can search the two computed tables, $\theta_1(x, y)$ and $\theta_2(x, y)$, to determine a location $(x_0, y_0)$ which gives values $\theta_1(x_0, y_0)\approx\tilde{\theta}_1$ and $\theta_2(x_0, y_0)\approx\tilde{\theta}_2$. The actual BHA position may be represented by the following equation:

$$(x,y)=(x_0+\Delta x, y_0+\Delta y), \tag{10}$$

where (Δx, Δy) is the offset of the BHA from $(x_0, y_0)$. Hence, the measured angles can be equated to the theoretical angles via the following:

$$\tilde{\theta}_1=\theta_1(x_0+\Delta x, y_0+\Delta y) \text{ and } \tilde{\theta}_2=\theta_2(x_0+\Delta x, y_0+\Delta y) \tag{11}$$

Expanding the two computed angles in Taylor series gives the following:

$$\theta_1(x_0+\Delta x, y_0+\Delta y) \approx \theta_1(x_0, y_0) + \Delta x \left.\frac{\partial \theta_1}{\partial x}\right|_{(x_0,y_0)} + \Delta y \left.\frac{\partial \theta_1}{\partial y}\right|_{(x_0,y_0)} \tag{12}$$

$$\theta_2(x_0+\Delta x, y_0+\Delta y) \approx \theta_2(x_0, y_0) + \Delta x \left.\frac{\partial \theta_2}{\partial x}\right|_{(x_0,y_0)} + \Delta y \left.\frac{\partial \theta_2}{\partial y}\right|_{(x_0,y_0)}, \tag{13}$$

where the partial derivatives are known, as they can be computed directly from the equations or from entries in the two tables. Rewriting equations (12) and (13) gives two equations in the two unknowns Δx and Δy:

$$\Delta\theta_1 \equiv \tilde{\theta}_1 - \theta_1(x_0, y_0) = \Delta x \frac{\partial \theta_1}{\partial x} + \Delta y \frac{\partial \theta_1}{\partial y}, \tag{14}$$

and

-continued $$\Delta\theta_2 \equiv \tilde{\theta}_2 - \theta_2(x_0, y_0) = \Delta x \frac{\partial \theta_2}{\partial x} + \Delta y \frac{\partial \theta_2}{\partial y} \tag{15}$$

These equations me be solved to find Δx and Δy:

$$\Delta x = \frac{\Delta\theta_1 \frac{\partial \theta_2}{\partial y} - \Delta\theta_2 \frac{\partial \theta_1}{\partial y}}{\frac{\partial \theta_1}{\partial x}\frac{\partial \theta_2}{\partial y} - \frac{\partial \theta_1}{\partial y}\frac{\partial \theta_2}{\partial x}} \text{ and } \Delta y = \frac{\Delta\theta_2 \frac{\partial \theta_1}{\partial x} - \Delta\theta_1 \frac{\partial \theta_2}{\partial x}}{\frac{\partial \theta_1}{\partial x}\frac{\partial \theta_2}{\partial y} - \frac{\partial \theta_1}{\partial y}\frac{\partial \theta_2}{\partial x}}. \tag{16}$$

Once Δx and Δy are obtained, the position of the BHA may be calculated from equation (10). Applying this algorithm to the previous example yields the BHA position (x, y)=(10.50, −0.87).

Table III set forth below includes magnetic field amplitude $B_{1t}$ for the first well pair versus x and y, and Table IV set forth below includes magnetic field amplitude $B_{2t}$ for the second well pair 230 versus x and y. In both Tables III and IV, units are nanoTesla per ampere. As discussed above, the BHA position may be determined without knowledge of the currents on the completed wells. However once (x, y) is known, it is possible to determine the currents. When the first well pair 220 is driven, the total magnetic field may be calculated with $\tilde{B}_{\bar{1}\bar{t}}=\sqrt{(\tilde{B}_{\bar{1}\bar{x}})^2+(\tilde{B}_{\bar{1}\bar{y}})^2}$. Table III contains a theoretical magnetic field amplitude $B_{1t}$ obtained with equation (7). Dividing the measured magnetic field amplitude $\tilde{B}_{\bar{1}\bar{t}}$ by the appropriate entry in Table III may yield the current $I_1(z)$ on the first well pair 220. Similarly, current on the second well pair 230 can be obtained by dividing the measured total magnetic field $\tilde{B}_{\bar{2}\bar{t}}$ by the appropriate entry in Table IV. Thus, $I_1(z)$ and $I_2(z)$ may be determined.

TABLE III

| | x = 9.00 | 9.25 | 9.50 | 9.75 | 10.00 | 10.25 | 10.50 | 10.75 | 11.00 |
|---|---|---|---|---|---|---|---|---|---|
| y = 1.00 | 25.56 | 24.54 | 23.57 | 22.64 | 21.76 | 20.91 | 20.11 | 19.34 | 18.61 |
| 0.75 | 24.98 | 24.00 | 23.06 | 22.17 | 21.31 | 20.50 | 19.72 | 18.98 | 18.27 |
| 0.50 | 24.42 | 23.47 | 22.56 | 21.70 | 20.87 | 20.09 | 19.33 | 18.62 | 17.93 |
| 0.25 | 23.85 | 22.94 | 22.06 | 21.23 | 20.43 | 19.67 | 18.95 | 18.26 | 17.59 |
| 0.00 | 23.30 | 22.41 | 21.57 | 20.77 | 20.00 | 19.27 | 18.57 | 17.90 | 17.26 |
| −0.25 | 22.74 | 21.89 | 21.08 | 20.31 | 19.57 | 18.86 | 18.19 | 17.54 | 16.92 |
| −0.50 | 22.20 | 21.38 | 20.60 | 19.85 | 19.14 | 18.46 | 17.81 | 17.18 | 16.59 |
| −0.75 | 21.66 | 20.87 | 20.12 | 19.40 | 18.72 | 18.06 | 17.43 | 16.83 | 16.25 |
| −1.00 | 21.12 | 20.37 | 19.65 | 18.96 | 18.30 | 17.66 | 17.06 | 16.48 | 15.92 |

TABLE IV

| | x = 9.00 | 9.25 | 9.50 | 9.75 | 10.00 | 10.25 | 10.50 | 10.75 | 11.00 |
|---|---|---|---|---|---|---|---|---|---|
| y = 1.00 | 21.12 | 20.37 | 19.65 | 18.96 | 18.30 | 17.66 | 17.06 | 16.48 | 15.92 |
| 0.75 | 21.66 | 20.87 | 20.12 | 19.40 | 18.72 | 18.06 | 17.43 | 16.83 | 16.25 |
| 0.50 | 22.20 | 21.38 | 20.60 | 19.85 | 19.14 | 18.46 | 17.81 | 17.18 | 16.59 |
| 0.25 | 22.74 | 21.89 | 21.08 | 20.31 | 19.57 | 18.86 | 18.19 | 17.54 | 16.92 |
| 0.00 | 23.30 | 22.41 | 21.57 | 20.77 | 20.00 | 19.27 | 18.57 | 17.90 | 17.26 |
| −0.25 | 23.85 | 22.94 | 22.06 | 21.23 | 20.43 | 19.67 | 18.95 | 18.26 | 17.59 |
| −0.50 | 24.42 | 23.47 | 22.56 | 21.70 | 20.87 | 20.09 | 19.33 | 18.62 | 17.93 |
| −0.75 | 24.98 | 24.00 | 23.06 | 22.17 | 21.31 | 20.50 | 19.72 | 18.98 | 18.27 |
| −1.00 | 25.56 | 24.54 | 23.57 | 22.64 | 21.76 | 20.91 | 20.11 | 19.34 | 18.61 |

Measuring $I_1(z)$ and $I_2(z)$ may provide quality control for the magnetic ranging. As the BHA drills deeper, the currents should slowly and monotonically decrease with depth as long as the currents injected at the surface are constant. The rate of change of I(z) may also provide information about the formation resistivity. Consider measurements at the depths z and z−Δz. By convention z decreases with increasing depth so that z−Δz is deeper than z (see FIG. 5). The change in current is thus $$\Delta I=I(z)-I(z-\Delta z), \tag{17}$$

which is known from measurements at the two depths. For sufficiently low frequencies, the voltage difference between the two completed wells at z is 2V for balanced drive (see FIG. 2). From equation (1), the formation resistivity between the two completed wells between z and z−Δz is related to the conductance per unit length by the following:

$$R_f = \frac{\pi}{\mathcal{G}\cosh^{-1}(S/d)}. \tag{18}$$

While the conductance between z and z−Δz is related to the voltage and current drop by the following:

$$\mathcal{G} = \frac{\Delta I}{2V\Delta z}. \tag{19}$$

Hence the formation resistivity may be derived from the following equation:

$$R_f = \frac{2\pi V\Delta z}{\Delta I\cosh^{-1}(S/d)}. \tag{20}$$

It should be noted that the magnetic field amplitudes $\tilde{B}_{\bar{1}\bar{t}}$ and $\tilde{B}_{\bar{2}\bar{t}}$ could also be used to determine the position of the BHA, assuming $I_1(z)$ and $I_2(z)$ have been obtained by the previously described method using the magnetic field direction. For example, the measured magnetic field amplitudes $\tilde{B}_{\bar{1}\bar{t}}$ and $\tilde{B}_{\bar{2}\bar{t}}$ could be used in conjunction with FIGS. 15 and 19 to graphically locate the position of the BHA. Alternatively, Tables III and IV could be used as previously described for the magnetic field direction. Or, an algorithm similar to that described by equation (16) could be used. However, using $\tilde{B}_{\bar{1}\bar{t}}$ and $\tilde{B}_{\bar{2}\bar{t}}$ to determine the BHA position may require a knowledge of $I_1(z)$ and $I_2(z)$, which were previously obtained from the BHA position.

Returning to the well pattern shown in FIGS. 1, 10 and 11, the position of well 12*h* may have been obtained by driving balanced currents on two well pairs, such as the first well pair 220 and the second well pair 230. This enables a driller to steer the BHA so that well 12*h* can be placed in the correct position with respect to the other wells. After drilling well 12*h* to total depth (TD), it may be completed by running a metal tubular to TD. Well 12 may then be used in a subsequent well pair to place the next well.

Figure 21:
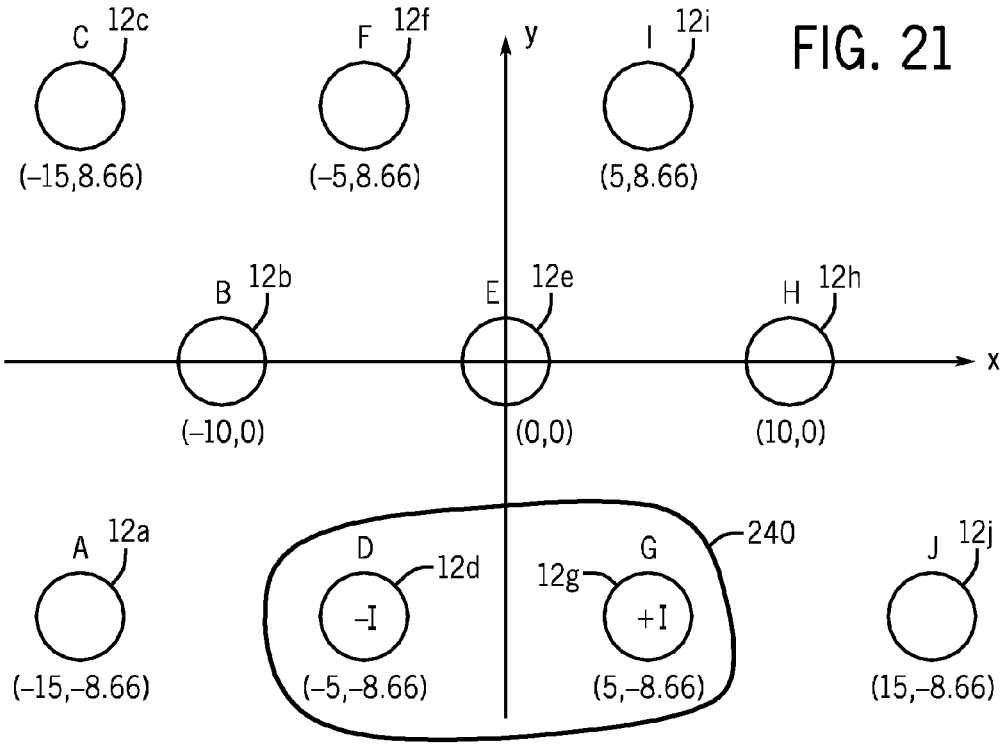
FIGS. 21 and 22 include plan views of an array of wells in accordance with an exemplary embodiment.
Figure 22:
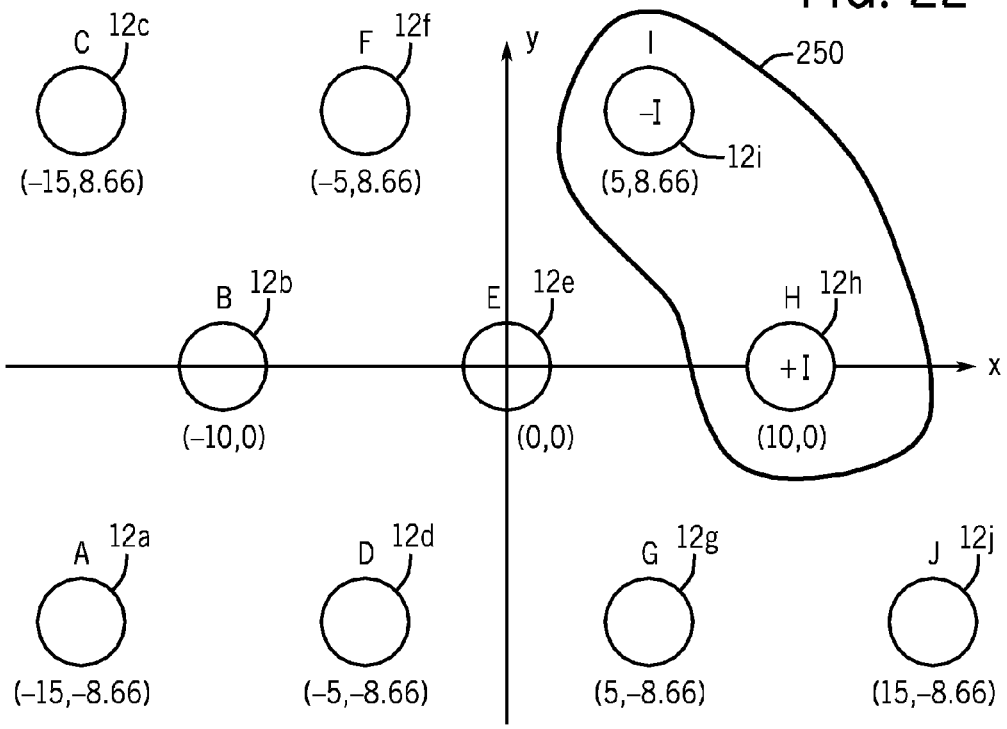
Figure 23:
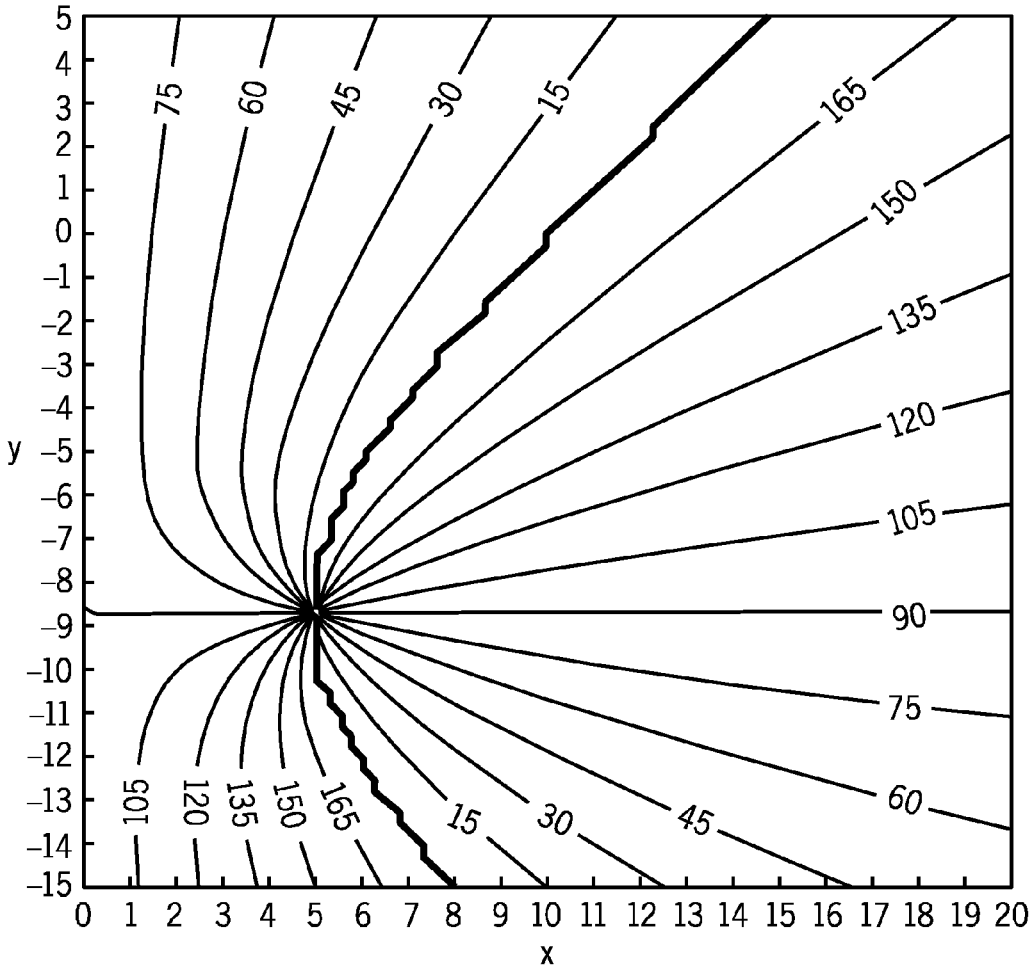
FIG. 23 includes a contour plot of a magnetic field direction for a well pair in accordance with an exemplary embodiment.
Figure 24:
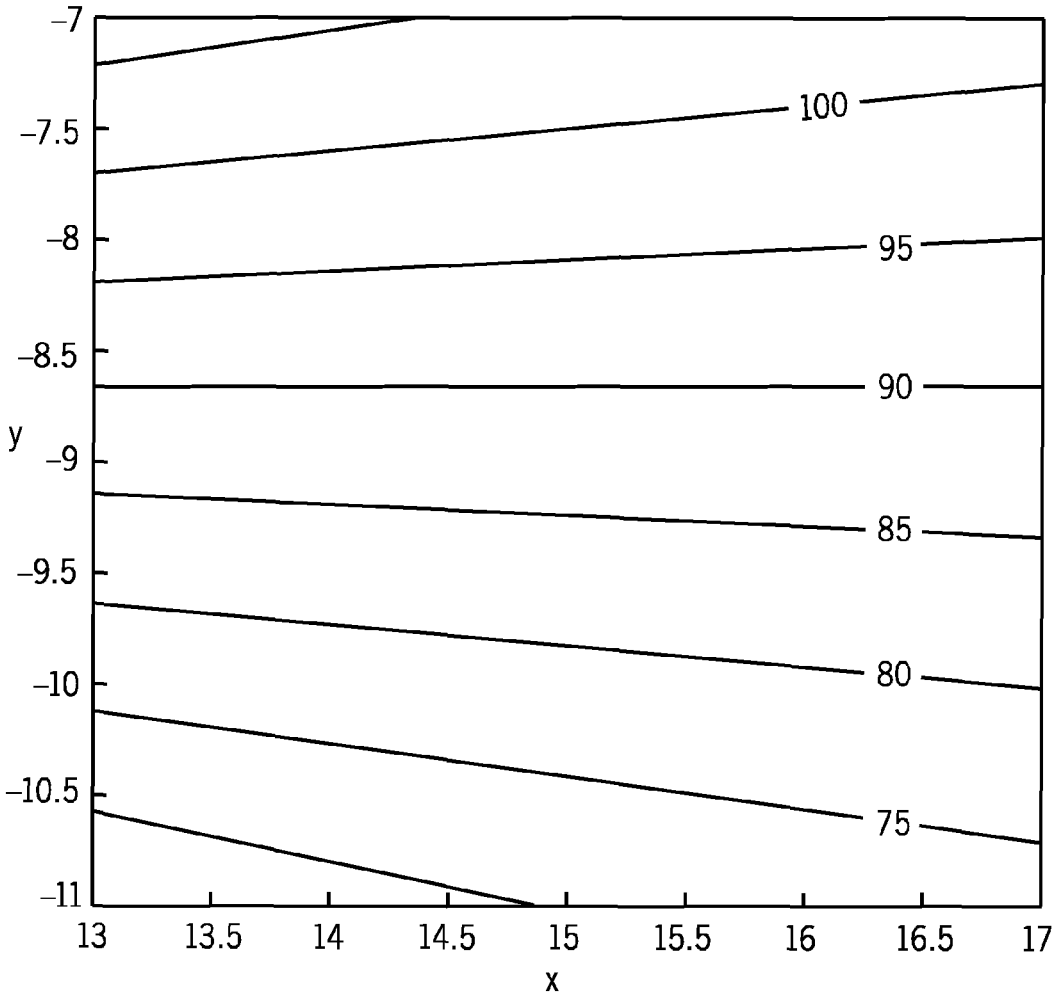
FIG. 24 includes an expanded contour plot of a magnetic field amplitude in accordance with an exemplary embodiment.
Figure 25:
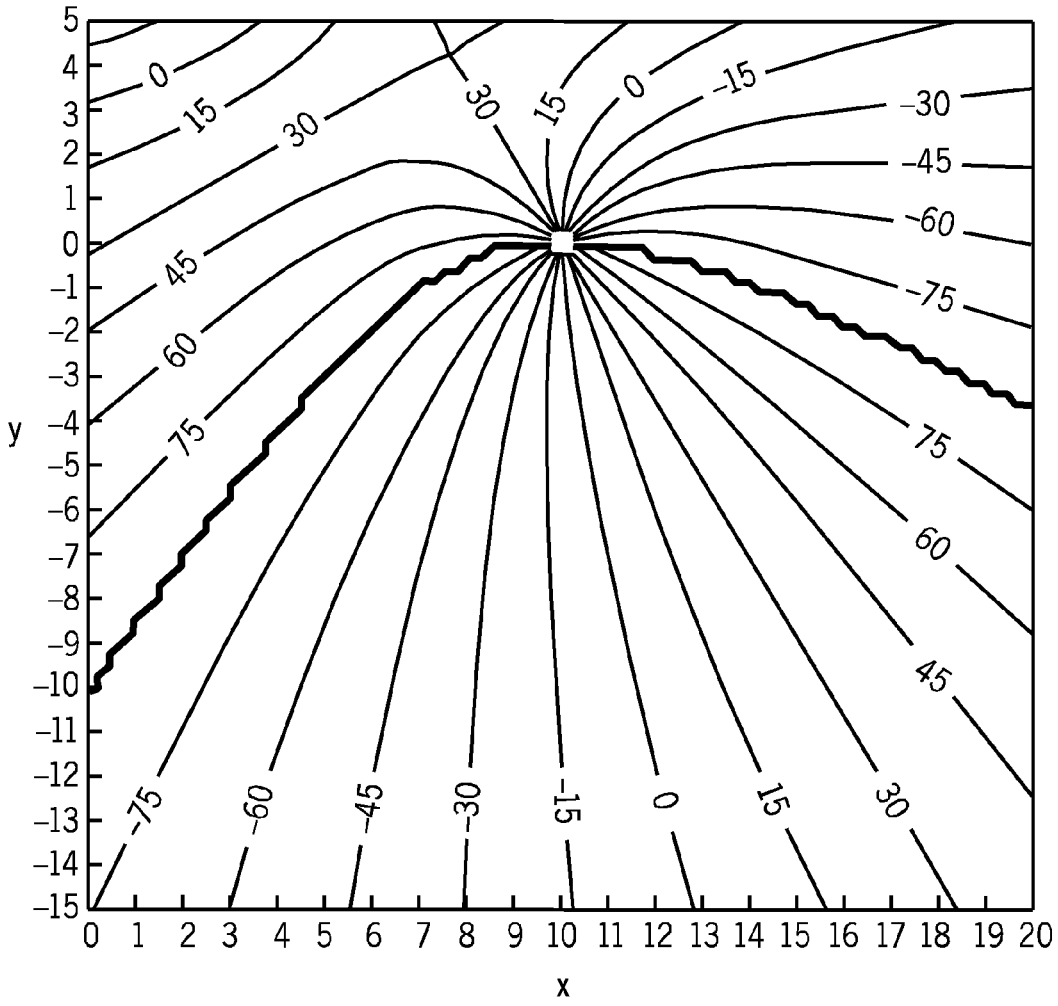
FIG. 25 includes a contour plot of a magnetic field direction for a well pair in accordance with an exemplary embodiment.
Figure 26:
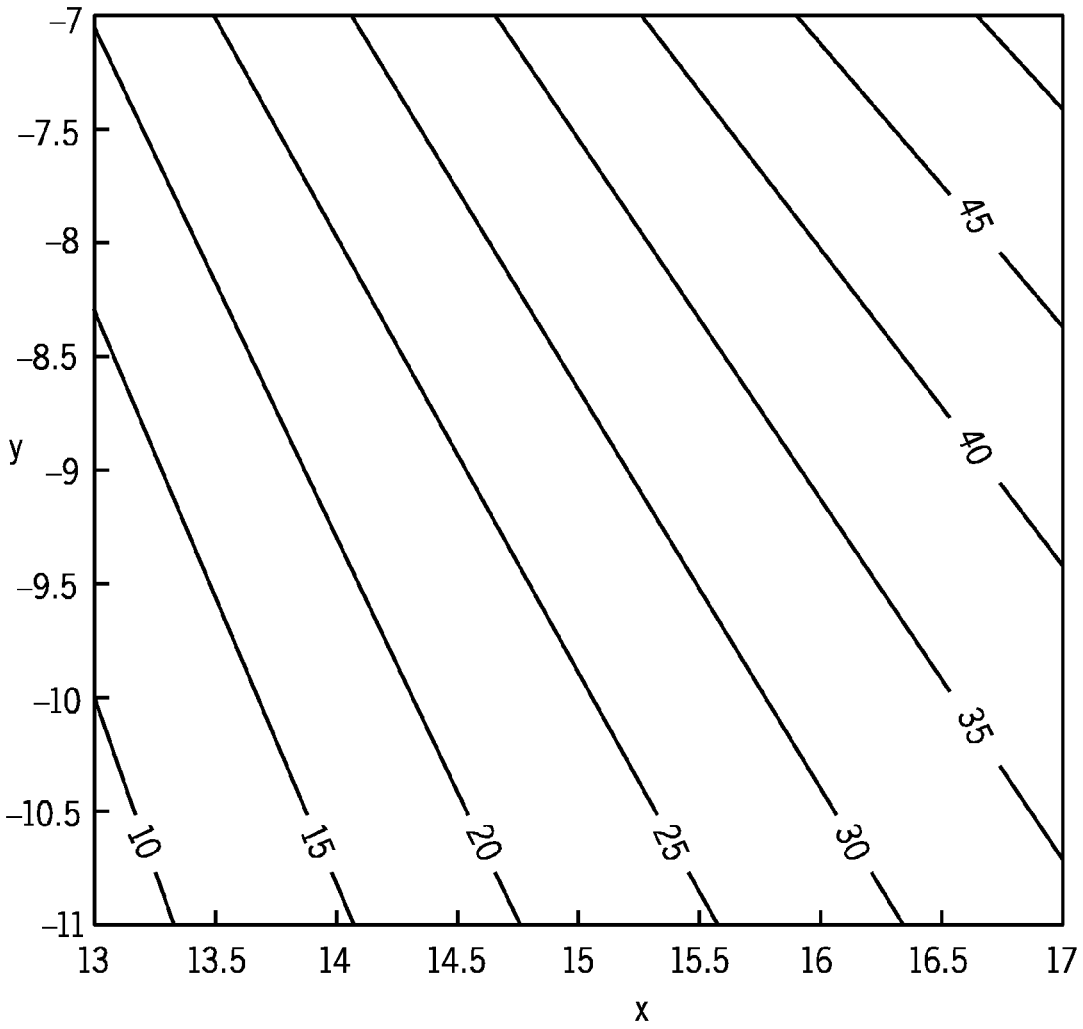
FIG. 26 includes an expanded contour plot of a magnetic field direction for a well pair in accordance with an exemplary embodiment.

FIGS. 21 and 22 illustrate the pattern 14 during a stage when the next well to be drilled is well 12*j*, which is to be located at (x, y)=(15, −8.66). Applying balanced currents to a third well pair 240, which includes wells 12*d* and 12*g*, may result in the contour plots of the magnetic field direction, $\theta_1(x, y)$, shown in FIGS. 23 and 24. In an exemplary embodiment, the proper angle for magnetic field direction may be $\theta_1(15, -8.66)=90°$. Applying balanced current to a fourth well pair 250, which includes wells 12*h* and 12*i* may produce a magnetic field that is 60° different in direction. Contour plots of the magnetic field direction $\theta_2(x, y)$, are shown in FIGS. 25 and 26. In an exemplary embodiment, the proper angle for the magnetic field direction is $\theta_2(15, -8.66)=30°$. The same procedures previously described for locating well 12*h* may now be applied to locate the position of well 12*j*. This may enable a driller to follow the proper trajectory for well 12*j* to TD. In a similar manner, well pairs including a pairing of wells 12*f* and 12*i*, and a pairing of wells 12*g* and 12*h* may be used to drill the well 12*l*, which may be next in a sequence (see FIG. 1). Once well 12*l* has been drilled to TD and completed, well 12*k* may be positioned with well pairs including a pairing of wells 12*h* and 12*l*, and a pairing of wells 12*h* and 12*j*. The process can be continued as needed or desired.

By the discussion set forth above, a method in accordance with an exemplary embodiment has been demonstrated with two examples. Specifically, the first example set forth above involves three completed wells and the second example involves four completed wells. It should be noted that methods in accordance with exemplary embodiments can also be applied with more than two pairs of wells. For example, referring to FIGS. 21 and 22, well 12*j* was located using the third well pair 240 (i.e., wells 12*d* and 12*g*) and the fourth well pair (i.e., wells 12*i* and 12*h*). Additional measurements could have been made using the well pairs that include a pairing of wells 12*g* and 12*h*, a pairing of wells 12*e* and 12*h*, and/or a pairing of wells 12*e* and 12*g*. High levels of accuracy may be achieved when well pairs are close to each other and close to the well being drilled. However, embodiments may also involve the utilization of well pairs that are separated by larger distances. For example, in drilling well 12*j*, a pairing of wells 12*a* and 12*g* could have been used instead of the pairing of wells 12*d* and 12*g* with limited loss of accuracy.

While exemplary embodiments described above may use certain features and arrangements, embodiments may also include a wide range of features, arrangements, procedures, and so forth. For example, while exemplary embodiments previously set forth describe wells in a triangular pattern, rectangular or square patterns of wells may also be drilled in accordance with exemplary embodiments. In fact, a method in accordance with one embodiment can be applied to essentially any configuration of wells, and does not require a regular or periodic well pattern. Exemplary embodiments may be applied in essentially any situation where there are three or more completed wells. Further, while an exemplary method has been described using a low frequency AC current source, exemplary embodiments may also use DC currents and make measurements with both positive and negative current polarities. Indeed, two sets of measurements may be obtained, and one may be subtracted from the other to remove the very large Earth magnetic field from the data. Further, exemplary embodiments may simultaneously drive both well pairs, but with different frequencies, $f_1$ for pair 1 and $f_2$ for pair 2. In view of this, the resulting magnetic field may have two frequency components, which can be separately determined by signal processing the output of the magnetometer.

Figure 27:
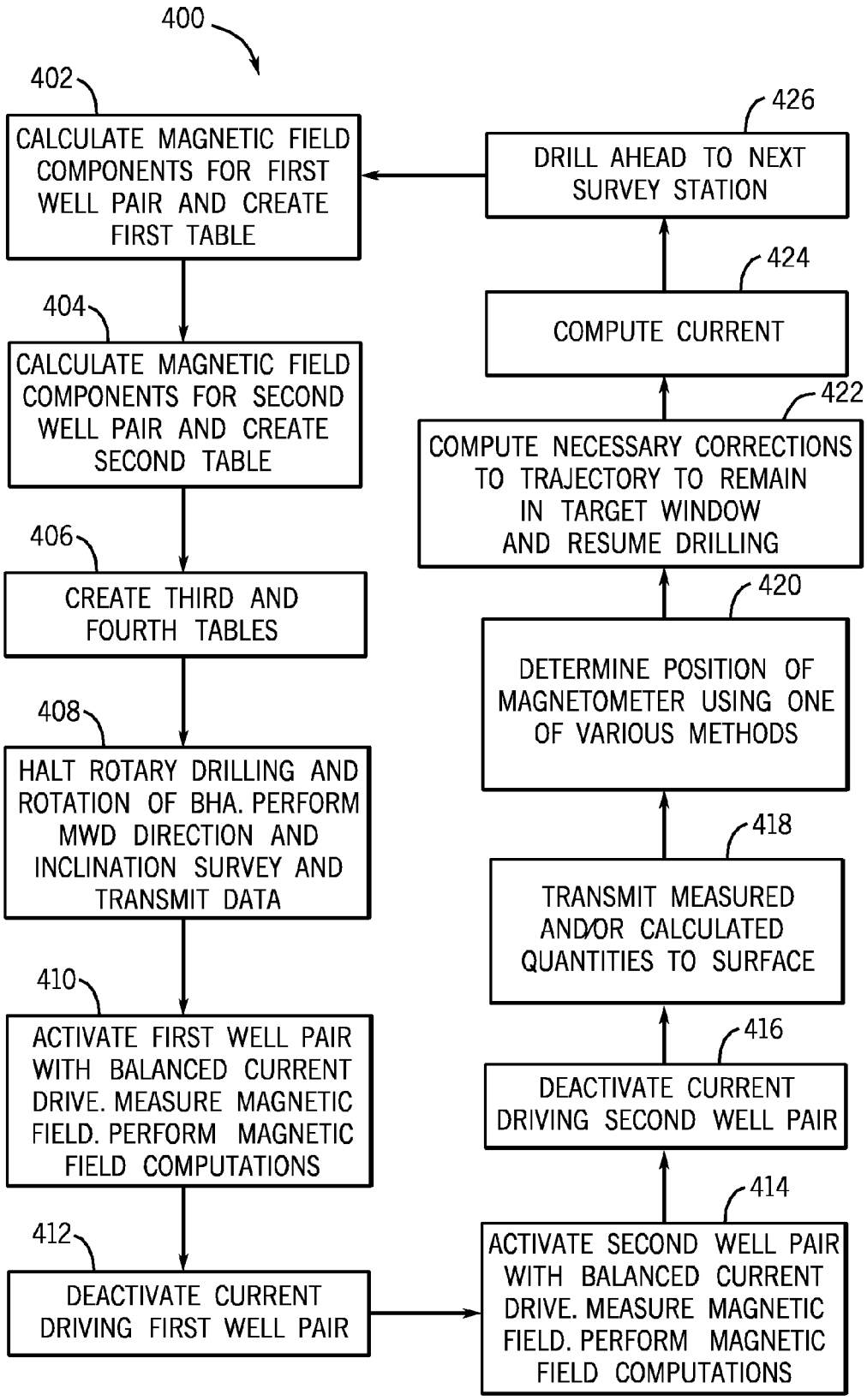
FIG. 27 includes a process flow diagram for a method in accordance with an exemplary embodiment.

FIG. 27 includes a process flow diagram that represents a general process in accordance with an exemplary embodiment. The process is generally indicated by reference numeral 400, and includes various functional blocks that may represent steps or acts in the process 400. It should be noted that, in some embodiments, methods and processes similar to the process 400 may include additional or fewer steps. Further, the steps or acts may be performed in a different order.

As represented by block 402, the process 400 begins with a calculation of magnetic field components for a first well pair and creation of a first table containing the magnetic field components for the first well pair. Specifically, block 402 may represent calculating the magnetic field components as functions of (x, y, z) for a first well pair with known locations $(x_1, y_1, z)$ and $(x_2, y_2, z)$ using $$B_{1x}(x, y, z) = -\frac{\mu_0 I_1(z)}{2\pi}\frac{(y-y_1)}{(x-x_1)^2+(y-y_1)^2} + \frac{\mu_0 I_1(z)}{2\pi}\frac{(y-y_2)}{(x-x_2)^2+(y-y_2)^2},$$

and $$B_{1y}(x, y, z) = \frac{\mu_0 I_1(z)}{2\pi}\frac{(x-x_1)}{(x-x_1)^2+(y-y_1)^2} - \frac{\mu_0 I_1(z)}{2\pi}\frac{(x-x_2)}{(x-x_2)^2+(y-y_2)^2},$$

where the well pair is driven in a balanced mode with current $\pm I_1(z)$. Further, block 402 may include creating the first table containing the magnetic field directions as a function of (x, y, z) for the first well pair using $\theta_1=\tan^{-1}(B_{1y}(x, y, z)/B_{1x}(x, y, z))$.

Block 404 represents a calculation of magnetic field components for a second well pair and creation of a second table containing the magnetic field components for the second well pair. Specifically, block 404 may include calculating the magnetic field components as functions of (x, y, z) for a second well pair with known locations $(x_3, y_3, z)$ and $(x_4, y_4, z)$, using $$B_{2x}(x, y, z) = -\frac{\mu_0 I_2(z)}{2\pi}\frac{(y-y_3)}{(x-x_3)^2+(y-y_3)^2} + \frac{\mu_0 I_2(z)}{2\pi}\frac{(y-y_3)}{(x-x_3)^2+(y-y_3)^2},$$

and.

$$B_{2y}(x, y, z) = \frac{\mu_0 I_2(z)}{2\pi}\frac{(x-x_4)}{(x-x_4)^2+(y-y_4)^2} - \frac{\mu_0 I_2(z)}{2\pi}\frac{(x-x_4)}{(x-x_4)^2+(y-y_4)^2},$$

where the second well pair is driven in a balanced mode with current $\pm I_2(z)$. Further, block 404 may include creating a second table containing magnetic field directions as a function of (x, y, z) for the second well pair using $\theta_2=\tan^{-1}(B_{2y}(x, y, z)/B_{2x}(x, y, z))$.

In some embodiments, third and fourth tables may be created, as illustrated by block 406. Specifically, block 406 may represent creating a third table containing the magnetic field amplitude as a function of (x, y, z) for the first well pair using $B_{1t}(x, y, z)=\sqrt{(B_{1x}(x,y,z))^2+(B_{1y}(x,y,z))^2}$, where the entries are in units of Tesla per ampere. Further, block 406 may represent creating a fourth table containing the magnetic field amplitude as a function of (x, y, z) for the second well pair using $B_{2t}(x, y, z)=\sqrt{B_{2x}(x,y,z))^2+(B_{2y}(x,y,z))^2}$, where the entries are in units of Tesla per ampere.

As represented by block 408, if rotary drilling, rotation of the BHA may be halted, and a standard MWD direction and inclination survey may be performed. Further, the data acquired from such a survey may be transmitted to the surface using MWD telemetry or the like.

As illustrated by block 410, the first well pair may be activated with a balanced current drive, the magnetic field may be measured, and magnetic field computations may be performed. Specifically, block 410 may include measuring the magnetic field using a three-axis magnetometer in the BHA to obtain the components $\tilde{B}_{\tilde{1}\tilde{x}}$ and $\tilde{B}_{\tilde{1}\tilde{y}}$, and computing the magnetic field direction $\tilde{\theta}_{\tilde{1}}=\tan^{-1}(\tilde{B}_{\tilde{1}\tilde{y}}/\tilde{B}_{\tilde{1}\tilde{x}})$. Further, the actions of block 410 may include computing the total magnetic field $\tilde{B}_{\tilde{1}\tilde{t}}=\sqrt{(\tilde{B}_{\tilde{1}\tilde{x}})^2+\tilde{B}_{\tilde{1}\tilde{y}})^2}$. Once the desired measurements and so forth have been obtained, the current driving the first well pair may be deactivated, as illustrated by block 412.

Block 414 may represent activating the second well pair with a balanced current drive, taking magnetic field measurements, and performing magnetic field computations. Specifically, block 414 may include measuring the magnetic field using a three-axis magnetometer in the BHA to obtain the components $\tilde{B}_{\tilde{2}\tilde{x}}$ and $\tilde{B}_{\tilde{2}\tilde{y}}$, and computing the magnetic field direction $\tilde{\theta}_{\tilde{2}}=\tan^{-1}(\tilde{B}_{\tilde{2}\tilde{y}}/\tilde{B}_{\tilde{2}\tilde{x}})$. Further, block 414 may include computing the total magnetic field $\tilde{B}_{\tilde{2}\tilde{t}}=\sqrt{(\tilde{B}_{\tilde{2}\tilde{x}})^2+(\tilde{B}_{\tilde{2}\tilde{y}})^2}$. Once the desired measurements and so forth have been obtained, the current driving the second well pair may be deactivated, as illustrated by block 416.

Block 418 represents transmitting measured and/or calculated quantities to the surface. Specifically, block 418 may include transmitting the measured and/or calculated quantities $\tilde{\theta}_{\tilde{1}}\bullet\tilde{\theta}_{\tilde{2}}\bullet\tilde{B}_{\tilde{1}\tilde{t}}\bullet$ and $\tilde{B}_{\tilde{2}\tilde{t}}$, to the surface using MWD telemetry.

Block 420 represents determining the (x, y) position of the magnetometer using one of various methods. For example, a first method may include plotting the measured angle $\tilde{\theta}_{\tilde{1}}$ as a contour line in the graph of $\theta_1(x, y)$, at depth z, and plotting the measured angle $\tilde{\theta}_{\tilde{2}}$ as a contour line in the graph of $\theta_2(x, y)$. In this first method, the two contour lines for $\tilde{\theta}_{\tilde{1}}$ and $\tilde{\theta}_{\tilde{2}}$ intersect at the magnetometer position. A second exemplary method that may be represented by block 420 may include finding the (x, y) entry in the two tables for $\theta_1(x, y)$ and $\theta_2(x, y)$ whose values are closest to the measured angles $\tilde{\theta}_{\tilde{1}}$ and $\tilde{\theta}_{\tilde{2}}$. A third exemplary method that may be represented by block 420 may include using the result of the second exemplary method to select a location $(x_0, y_0)$ in the tables whose values are close to $\tilde{\theta}_{\tilde{1}}$ and $\tilde{\theta}_{\tilde{2}}$, calculating the differences $\Delta\theta_1\equiv\tilde{\theta}_{\tilde{1}}-\theta_1(x_0, y_0)$ and $\Delta\theta_2\equiv\tilde{\theta}_{\tilde{2}}-\theta_2(x_0, y_0)$, computing partial derivatives at $(x_0, y_0)$:

$$\frac{\partial\theta_1}{\partial x}, \frac{\partial\theta_1}{\partial y}, \frac{\partial\theta_2}{\partial x}, \frac{\partial\theta_2}{\partial y},$$

computing $\Delta x$ and $\Delta y$ with $$\Delta x = \frac{\Delta\theta_1\frac{\partial\theta_2}{\partial y}-\Delta\theta_2\frac{\partial\theta_1}{\partial y}}{\frac{\partial\theta_1}{\partial x}\frac{\partial\theta_2}{\partial y}-\frac{\partial\theta_1}{\partial y}\frac{\partial\theta_2}{\partial x}} \text{ and } \Delta y = \frac{\Delta\theta_2\frac{\partial\theta_1}{\partial x}-\Delta\theta_1\frac{\partial\theta_2}{\partial x}}{\frac{\partial\theta_1}{\partial x}\frac{\partial\theta_2}{\partial y}-\frac{\partial\theta_1}{\partial y}\frac{\partial\theta_2}{\partial x}}.$$

Based on the third exemplary method, the magnetometer position may be determined as $(x, y)=(x_0+\Delta x, y_0+\Delta y)$.

Block 422 represents computing any necessary corrections to the trajectory to remain in the target window and resume drilling. Block 424 represents computing a value for current. Specifically, block 424 may include computing the current $I_1(z)$ by dividing the measured magnetic field $\tilde{B}_{\tilde{1}\tilde{t}}$ by the appropriate entry from the third table containing values for $B_{1t}(x, y, z)$. In some embodiments, block 424 may include computing the current $I_2(z)$ by dividing the measured magnetic field $\tilde{B}_{\tilde{2}\tilde{t}}$ by the appropriate entry from the fourth table containing values for $B_{2t}(x, y, z)$.

Block 426 represents drilling ahead to the next survey station. Once the survey station is reached, the process 400 may be performed again in accordance with an exemplary embodiment.

Figure 28:
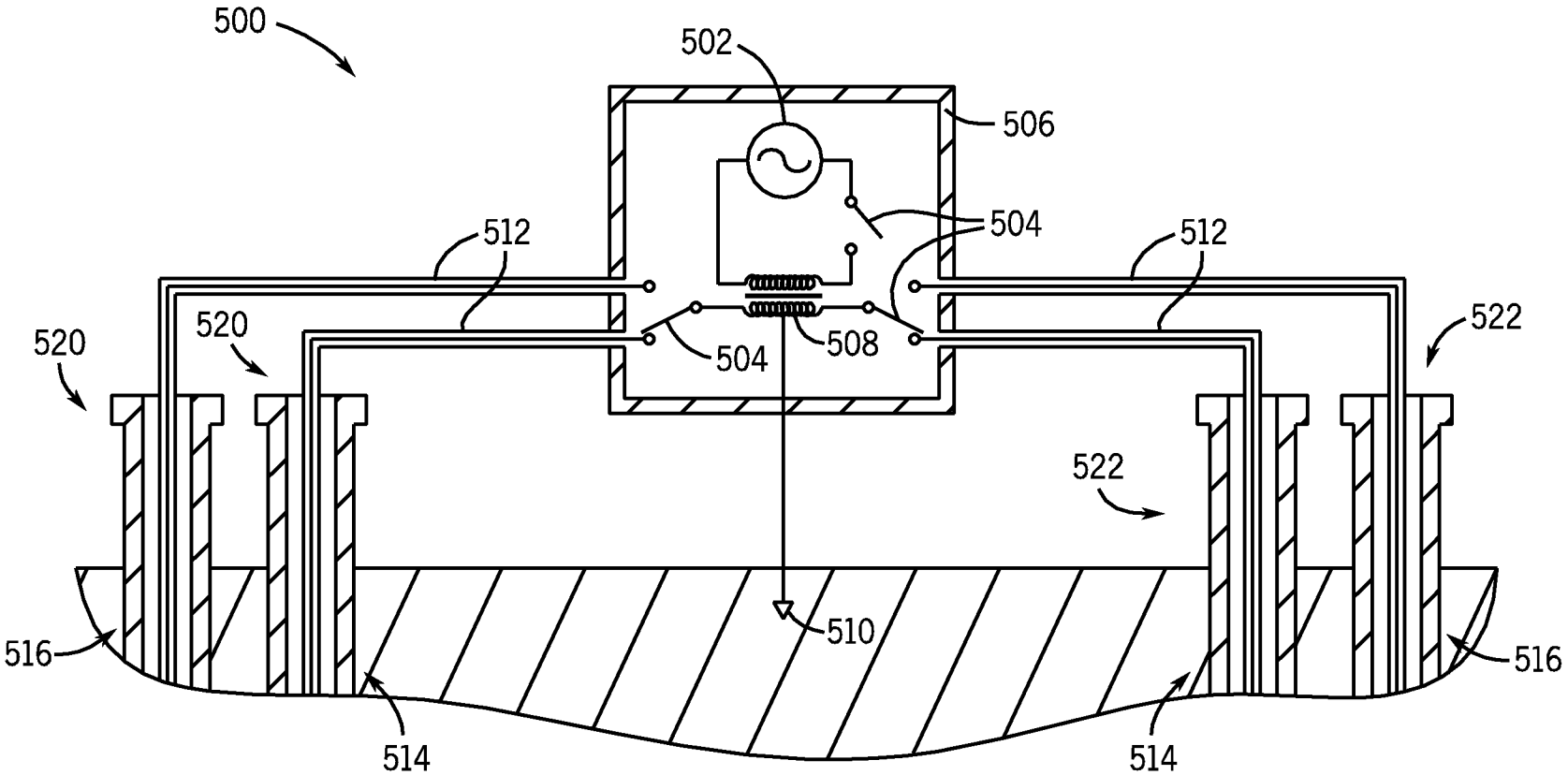
FIG. 28 includes a cross-sectional and schematic view of surface equipment that is capable of producing currents on pairs of completed wells in accordance with an exemplary embodiment.

FIG. 28 includes a cross-sectional and schematic view of surface equipment 500 that is capable of producing currents on pairs of completed wells in accordance with an exemplary embodiment. The surface equipment 500 may facilitate application of current to the wells (e.g., well casing) at a subsurface location. In some embodiments, currents may be applied directly to the casings at the surface. However, in the illustrated embodiment, currents and voltages at the surface are electrically shielded. The well heads may be in a region near the drilling rig where there are restrictions on any electrical equipment that might produce a spark. Hence, a design where all electrical circuits are shielded and/or enclosed in explosion-proof boxes may be utilized.

Specifically, in FIG. 28 a current generator balanced transformer 502, and switches 504 are enclosed in an electrically shielded, explosion-proof box 506. A center tap 508 of the secondary transformer is connected to Earth ground 510, as is the explosion-proof box 506. The transformer's outputs are connected to switches 504 which connect in turn to armored cables 512. The switches 504 can be used to turn the AC currents on and off, and to direct the currents to pairs of wells 514 and 516. The armored cables 512 may include an outer conductive sheath that is maintained at Earth ground. Also, explosion-proof connectors may be used to connect the cables 512 to the explosion-proof box 506. Accordingly, no voltages or currents may be applied to well heads pairs 520 and 522.

Figure 29:
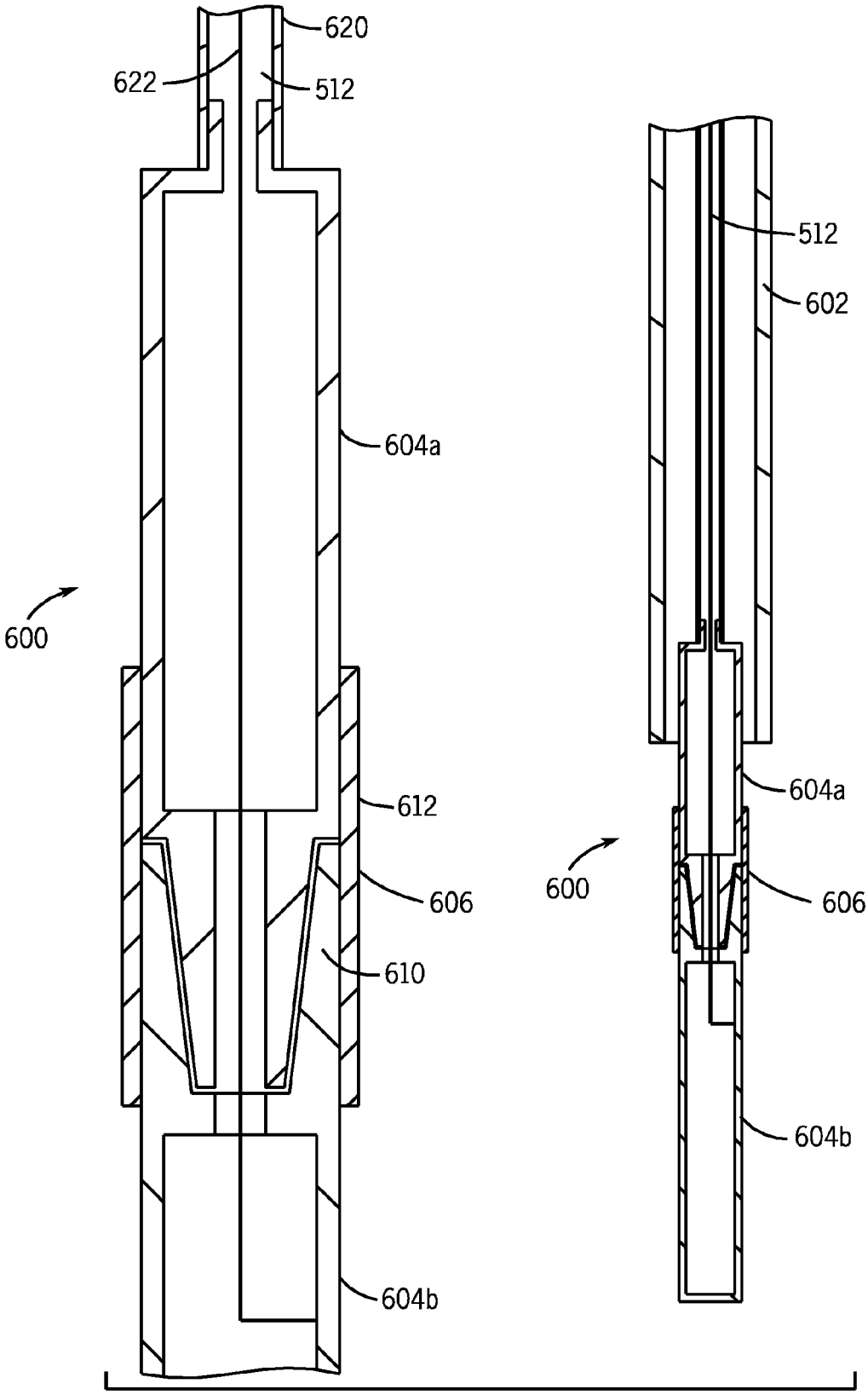
FIG. 29 illustrates a pair of cross-sectional views of downhole equipment 600 that may be utilized to limit exposure of current and voltage in accordance with an exemplary embodiment.

FIG. 29 illustrates a pair of cross-sectional views of downhole equipment 600 that may be utilized to limit exposure of current and voltage in accordance with an exemplary embodiment. Referring to FIG. 29, a subsurface design that correlates to the surface equipment 500 of FIG. 28 is shown. The armored cable 512 extends through well casing 602 and attaches to a metal tubing 604. The metal tubing 604 contains an insulated joint 606 that provides mechanical strength while electrically separating two portions of the tubing. An upper portion **604*a* of the tubing may extend inside the casing 602, but a lower portion 604*b* is below the end of the casing 602. The insulated joint 606 consists of an insulating connection 610 and an insulating jacket 612. One method for forming the insulated connection 610 may include coating a male thread with a thin insulating ceramic coating. The insulated joint 606 may then be made up to a high torque and the insulating jacket 612** may be added over the connection.

In the illustrated embodiment, an outer jacket 620 of the armored cable 512 attaches to the outside of the upper tubing **604*a*. An insulated inner conductor or wire 622 of the armored cable 512 attaches to the lower tubing 604*b*. This wire 622 carries the current used to energize the associated well pair. The purpose of the insulated joint 606 may include reducing the amount of current leaving the lower tubing 604*b* and returning on the casing 602 or armored cable jacket to the surface. The longer the insulated jacket 612, the less likely that current will return on the well casing 602 or armored cable 512. In an exemplary embodiment, the length of the insulted jacket 612 will equal or exceed the inter-well spacing such that the resistance between the lower tubing 604***b* and the casing 602 will be much larger than the resistance between the lower portions of tubing 604*b* for the two wells. In this case, most of the current will flow between the lower tubing 604*b* of the two wells, rather than returning on the armor 152 or casing 602. Any current that does return to the surface via the armor tend to be inside the armor, and thus it does not present an electrical hazard on the surface.

Compared to driving current directly on the well casing at surface, more current can be delivered to the lower reaches of the well. Since the current is confined to an insulated wire in the upper portions of the well, there will be far less current leaking into the formation at the shallower depths. This is particularly advantageous if there are low resistivity layers in a shallow formation, such as illustrated in FIG. 4. This increases the magnetic field at depth for a given current injected at surface, while reducing the power applied to the well pair.

The metal tubing 604*b* in the lower portion of the well may contain heating elements, and the armored cable 512 may contain additional wires to supply power to the heater elements. Alternatively, the tubing 604 may extend to surface and simply be part of a production string. In this case, the armored cable 512 may be withdrawn before the well goes on production.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A method for relative positioning of wells, comprising the steps of:

drilling a new well in a field having at least three completed wells using a drilling tool comprising a magnetometer;

driving current on a first pair of the at least three completed wells and then driving current on a second pair of the at least three completed wells, wherein the current is driven on each of the first and second pairs in a balanced mode;

measuring a direction of a first magnetic field generated by the current on the first pair using the magnetometer;

measuring a direction of a second magnetic field generated by the current on the second pair using the magnetometer; and determining a location of the drilling tool relative to the completed wells based on the direction of the first magnetic field and the direction of the second magnetic field.

2. The method of claim 1, wherein measuring the direction of the first magnetic field and the direction of the second magnetic field comprises computing angles for each of the first magnetic field and the second magnetic field based on measured magnetic field components.

3. The method of claim 2, wherein determining the location of the drilling tool comprises defining contour lines based on the angles for each of the first magnetic field and the second magnetic field and identifying an intersection of the contour lines.

4. The method of claim 1, wherein drilling the new well with the drilling tool comprises drilling the new well with a bottom hole assembly including a three-axis magnetometer.

5. The method of claim 1, comprising inhibiting current flow on a drill string of the drilling tool with a drill collar divided by an insulated gap.

6. The method of claim 1, comprising driving AC current or driving DC current on the first and second pairs.

7. The method of claim 1, comprising mathematically rotating the axes of the magnetometer to correspond to an x-y-z coordinate system defined by the completed wells.

8. The method of claim 1, comprising driving the current with a current generator coupled to the first pair and then coupled to the second pair.

9. The method of claim 1, wherein driving the current on the second pair comprises driving current on one well that was in the first pair.

10. The method of claim 1, comprising performing the steps in the recited order.

11. A method of drilling wells relative to one another, comprising the steps of:

measuring components of a first magnetic field generated from a first balanced current on a first well pair with a magnetometer;

determining a first magnetic field direction of the first magnetic field based on the components of the first magnetic field with a processor;

measuring components of a second magnetic field generated from a second balanced current on a second well pair with the magnetometer;

determining a second magnetic field direction of the second magnetic field based on the components of the first magnetic field with the processor; and determining a location of the magnetometer relative to the first and second well pair based on the first and second magnetic field directions.

12. The method of claim 11, wherein determining the location of the magnetometer, comprises plotting each of the first and second magnetic field directions as a contour line and identifying an intersection between the contour lines.

13. The method of claim 11, wherein determining the location of the magnetometer, comprises respectively identifying an entry nearest a value for each of the first and second magnetic field directions in tables containing magnetic field components for the first and second well pairs.

14. A system for drilling wells in an arrangement relative to one another, comprising:

a current generator balanced transformer;

cable extending from the current generator balanced transformer, wherein the cable is capable of coupling a pair of completed wells with the current generator balanced transformer such that current from the current generator balanced transformer can pass through the pair of completed wells in a current balanced mode; and a drilling tool comprising a magnetometer capable of detecting a direction of a magnetic field produced by the current passing through the pair of completed wells to facilitate calculation of a location of the drilling tool relative to the pair of completed wells.

15. The system of claim 14, comprising an explosion-proof box surrounding the current generator balanced transformer.

16. The system of claim 14, wherein the cable comprises an outer conductive sheath capable of communicatively coupling to an Earth ground.

17. The system of claim 14, comprising subsurface tubing configured for positioning below a surface level and coupling with the cable.

18. The system of claim 14, comprising a transmitter capable of transmitting data acquired by the drilling tool to surface equipment.

19. The system of claim 14, wherein the cable is capable of coupling a different pair of completed wells with the current generator balanced transformer such that current from the current generator balanced transformer can pass through the different pair of completed wells in a current balanced mode.

20. The system of claim 19, wherein the drilling tool is capable of detecting a different direction of a different magnetic field produced by the current passing through the different pair of completed wells to facilitate calculation of the location of the drilling tool relative to the pair of completed wells and the different pair of completed wells.

* * * * *